US007658572B2

(12) United States Patent
Miyao et al.

(10) Patent No.: US 7,658,572 B2
(45) Date of Patent: Feb. 9, 2010

(54) TIDE APPARATUS AND TIDE STRUCTURE

(75) Inventors: Susumu Miyao, Toda (JP); Isao Banno, Nagoya (JP); Hideki Fujita, Sanda (JP)

(73) Assignee: Spacetech, Co., Ltd., Tokyo (JP)

( * ) Notice: Subject to any disclaimer, the term of this patent is extended or adjusted under 35 U.S.C. 154(b) by 382 days.

(21) Appl. No.: 11/663,245

(22) PCT Filed: Jul. 26, 2006

(86) PCT No.: PCT/JP2006/314814

§ 371 (c)(1),
(2), (4) Date: Mar. 19, 2007

(87) PCT Pub. No.: WO2008/012887

PCT Pub. Date: Jan. 31, 2008

(65) Prior Publication Data

US 2009/0220301 A1 Sep. 3, 2009

(51) Int. Cl.
*E02B 7/20* (2006.01)

(52) U.S. Cl. ..... 405/96; 405/104; 405/92; 405/107; 52/169.14

(58) Field of Classification Search ..... 405/87, 405/92, 93, 94, 96, 97, 100, 103, 104, 107; 52/169.14
See application file for complete search history.

(56) References Cited

U.S. PATENT DOCUMENTS 3,495,411 A * 2/1970 Clemens ..... 405/96
5,460,462 A * 10/1995 Regan ..... 405/96
5,725,326 A * 3/1998 Van den Noort ..... 405/104
6,029,405 A * 2/2000 Wood ..... 52/169.14
6,425,707 B1 * 7/2002 Baxter ..... 405/104
6,485,231 B2 * 11/2002 Montgomery et al. ..... 405/96
6,514,011 B2 * 2/2003 Nomura et al. ..... 405/107
6,623,209 B1 * 9/2003 Waters, Jr. ..... 405/94
6,692,187 B2 * 2/2004 Sprengle et al. ..... 405/96
7,083,359 B2 * 8/2006 Aughton et al. ..... 405/100
7,244,078 B2 * 7/2007 Aughton et al. ..... 405/100
7,497,644 B1 * 3/2009 Cohen ..... 405/96
2003/0190193 A1 * 10/2003 Waters, Jr. ..... 405/87

FOREIGN PATENT DOCUMENTS

JP (1995) 7-197751 A 8/1995
JP (2000) 2000-319857 A 11/2000

* cited by examiner

*Primary Examiner*—Frederick L Lagman
(74) *Attorney, Agent, or Firm*—The Webb Law Firm

(57) ABSTRACT

It is an object to provide a tide apparatus comprising a storage tank connected to a underground pit for normally storing water of a constant amount, a connecting pipe for connecting between the underground pit and the storage tank, and a seismograph releasing apparatus formed on the connecting pipe for sensing a shake in an earthquake and for releasing the water stored in the storage tank into the underground pit, wherein the tide plate can protrude upward from the soil foundation face by operating the seismograph releasing apparatus in an earthquake to make the water stored in the storage tank flow into the underground pit via the connecting pipe.

16 Claims, 29 Drawing Sheets

TIDE APPARATUS AND TIDE STRUCTURE

TECHNICAL FIELD

The present invention relates to a tide apparatus and tide structure that: are disposed around a building or a civil engineering work piece for preventing an infiltration or an outflow of water during a tsunami or a flood caused by an earthquake or the like.

BACKGROUND ART

For instance, in an area in which an inundation may occur due to a tsunami or a flood caused by an earthquake or the like, an infiltration or an outflow of water has been generally prevented by raising the soil foundations of a building or by building levees on the both banks of a river.

Around a building in which the soil foundations cannot be raised, a tide plate is generally installed at the location in which a water flow must be cut off, and the water is kept back by the tide plate.

A conventional tide plate of this kind is generally formed in any shape such as a flat plate, and is installed manually in advance at the location in which water must be kept back in the case in which overhead flooding may occur.

Moreover, a tide apparatus in which a tide plate powered by electricity can be moved up and down has also been developed. The sensor of the tide apparatus detects the time when the tide plate must be installed in overhead flooding or the like, and water is kept back by automatically raising the tide plate based on a signal output from the sensor.

However, in the case in which the soil foundations of a building are raised, a staircase must be formed for going in and out of the building, thereby resulting in inconvenience in utilizing the building.

Moreover, in the case in which a tide plate is installed manually, the prediction of a flood does not come true in some cases and the installation of the tide plate is futile. In the case in which heavy rain occurs suddenly and hands are insufficient, the tide plate cannot be installed. In addition, an installation of the tide plate may prevent a person from going in and out in some cases.

That is to say, it is preferable that the tide plate is normally housed in a separate site such as under the soil foundation face in such a manner that the tide plate does not obstruct the entrance and exit or the passage, thereby improving a convenience in utilizing the building.

Unfortunately, in the case in which the tide plate is powered by electricity to be moved up and down, the tide plate does not operate by a failure or a power outage in some cases, and an installation cost becomes extremely high.

Therefore, a tide apparatus 100 shown in FIG. 28 as disclosed in Patent document 1 (Japanese Patent Application Laid-Open Publication No. 7-197751) has been proposed as a tide apparatus for automatically installing the tide plate in order to keep back water in overhead flooding or the like without utilizing power such as human power and electricity.

The tide apparatus 100 contains an underground pit 102 formed under a soil foundation face 110, a water inflow port 106 and a slit 108 that vertically penetrate into a ceiling wall 104 of the underground pit 102, and a tide plate 112 that is linked to a floating member 114 at the bottom end of the tide plate in the underground pit 102 for floating together with the floating member 114 by a buoyancy of water and that can protrude upward from the soil foundation face 110 through the slit 108.

For the tide apparatus 100, in the case in which overhead flooding occurs on the ground due to a flood caused by a heavy rain, water flows and gathers into the underground pit 102 from the water inflow port formed in the ceiling wall 104 of the underground pit 102. A buoyancy of the water that has gathered inside is then applied to the floating member 114, and the tide plate 112 rises together with the floating member 114 and protrudes upward from the soil foundation face 110, thereby keeping back water.

Patent document 2 (Japanese Patent Application Laid-Open Publication No. 2000-319857) discloses a tide apparatus 200 as shown in FIG. 29, in which an underground pit 202 is formed under a soil foundation face, a water inflow port 206 and a tide plate operation opening 208 that vertically penetrate into a ceiling wall 204 of the underground pit 202 are formed, the tide plate 210 is rotatably mounted in a pivoting manner to one end of the tide plate operation opening 208, and a floating member 214 located in the underground pit 202 is linked to a surface 212 on the underground pit 202 side of the tide plate 210 via the tide plate operation opening 208. A buoyancy of water raises the floating member 214 and rotates the tide plate 210, thereby installing the tide plate 210 in a standing manner above the soil foundation face.

Patent document 1: Japanese Patent Application Laid-Open Publication No. 7-197751

Patent document 2: Japanese Patent Application Laid-Open Publication No. 2000-319857

However, in the case in which no water flows into the underground pit 102 or 202 via the inflow port 106 or 206 in practice for such conventional tide apparatuses 100 and 200, the tide plate L12 or 210 cannot be installed in a standing manner above the soil foundation face.

That is to say, in the case in which no overhead flooding occurs on the ground due to a flood or the like, the tide apparatuses 100 and 200 are not operated.

In the case in which an outflow of water occurs due to a collapse of a levee or a tsunami caused by an earthquake, water does not gradually flood on the soil foundation face but a large amount of water flows once and for all in many cases. In this case, the operation of the tide apparatus is not useful for keeping back water.

Moreover, for the tide apparatus in accordance with the conventional art, in the case in which water flows into the underground pit, the tide plate protrudes upward from the soil foundation face. Consequently, even in the case in which drainage is slow in a normal rainfall, the tide plate operates, thereby obstructing the passage in some cases.

Once the tide plate is installed in a standing manner above the soil foundation face, the installing condition in a standing manner is maintained until the drainage of water in the underground pit is completed. Consequently, the tide plate obstructs the passage in the case in which a disaster occurs. For instance, an emergency vehicle cannot pass and rescue is delayed in some cases.

The present invention was made in consideration of such conditions, and an object of the present invention is to provide a tide apparatus for automatically installing the tide plate in order to reliably keep back water in overhead flooding or the like without depending on power such as human power and electricity and for installing the tide plate in advance in order to reliably keep back water in overhead flooding or the like even in the case in which a large amount of water flows once and for all due to a collapse of a levee or a tsunami caused by an earthquake.

Another object of the present invention is to provide a tide apparatus in which the tide plate is not operated in the case of a normal rainfall to prevent the passage from being obstructed.

Another object of the present invention is to provide a tide apparatus in which the tide plate that has protruded upward from the soil foundation face can be immediately drawn below the soil foundation face, thereby preventing the passage from being obstructed in the case in which a disaster occurs.

SUMMARY OF THE INVENTION

The present invention was made in order to solve the above problems of the conventional art and to achieve the objects. A tide apparatus in accordance with the present invention is characterized by comprising:

an underground pit formed under a soil foundation face;

a water inflow port and a tide plate operation opening for vertically penetrating into a ceiling wall of the underground pit;

a tide plate linked to a floating member at the bottom end thereof in the underground pit for floating together with the floating member by a buoyancy of water; wherein the tide plate can protrude upward from the soil foundation face through the tide plate operation opening by making water flow into the underground pit via the inflow port of the ceiling wall;

a storage tank connected to the underground pit for normally storing water of a constant amount;

a connecting pipe for connecting between the underground pit and the storage tank; and a seismograph releasing apparatus formed on the connecting pipe for sensing a shake in an earthquake and for releasing the water stored in the storage tank into the underground pit;

wherein the tide plate can protrude upward from the soil foundation face by operating the seismograph releasing apparatus in an earthquake to make the water stored in the storage tank flow into the underground pit via the connecting pipe.

By such a configuration, in the case in which overhead flooding occurs on the ground due to a flood caused by a heavy rain, water flows and gathers into the underground pit from the water inflow port formed in the ceiling wall of the underground pit. A buoyancy of the water that has gathered in the underground pit is then applied to the floating member, and the tide plate rises together with the floating member and protrudes upward from the soil foundation face, thereby keeping back water.

Moreover, a storage tank is connected to the underground pit for normally storing water of a constant amount, and a seismograph releasing apparatuses formed on the connecting pipe that connects between the underground pit and the storage tank. Consequently, the seismograph releasing apparatus is operated in an earthquake to make the water stored in the storage tank in advance flow into the underground pit via the connecting pipe. A buoyancy of the water that has gathered in the underground pit is then applied to the floating member, and the tide plate rises together with the floating member and protrudes upward from the soil foundation face, thereby keeping back water.

The tide apparatus in accordance with the present invention is characterized in that the storage tank is formed under the soil foundation face.

In the case in which the storage tank is formed under the soil foundation face as described above, the entrance and exit or the passage are not obstructed, thereby preventing a convenience in utilizing the building from being lost, in the case in which the tide apparatus is not operated under the normal conditions.

Moreover, in the case in which the storage tank is formed under the soil foundation face, the appearance is neat, thereby improving the beauty of the building, and the passage is not obstructed.

The tide apparatus in accordance with the present invention is characterized in that the storage tank is formed over the soil foundation face.

In the case in which the storage tank is formed over the soil foundation face as described above, an amount of water in the storage tank can be less than that in the case in which the storage tank is formed under the soil foundation face, thereby miniaturizing the storage tank.

Moreover, the excavating and burying operations for forming the storage tank under the soil foundation face are not required, thereby suppressing an execution cost.

A tide structure in accordance with the present invention is characterized in that a plurality of the tide apparatuses described above is disposed in parallel.

By such a configuration, water can be kept back in the desired length.

A tide apparatus in accordance with the present invention is characterized by comprising:

an underground pit formed under a soil foundation face;

a water inflow port and a tide plate operation opening for vertically penetrating into a ceiling wall of the underground pit;

a tide plate rotatably mounted in a pivoting manner to one end of the tide plate operation opening;

a floating member located in the underground pit and linked to a surface on the underground pit side of the tide plate via the operation opening; wherein the floating member rises via the tide plate operation opening and rotates the tide plate by making water flow into the underground pit via the inflow port of the ceiling wall, thereby installing the tide plate in a standing manner above the soil foundation face;

a storage tank connected to the underground pit for normally storing water of a constant amount;

a connecting pipe for connecting between the underground pit and the storage tank; and a seismograph releasing apparatus formed on the connecting pipe for sensing a shake in an earthquake and for releasing the water stored in the storage tank into the underground pit;

wherein the tide plate can protrude upward from the soil foundation face by operating the seismograph releasing apparatus in an earthquake to make the water stored in the storage tank flow into the underground pit via the connecting pipe.

By such a configuration, in the case in which overhead flooding occurs on the ground due to a flood caused by a heavy rain, water flows and gathers into the underground pit from the water inflow port formed in the ceiling wall of the underground pit. A buoyancy of the water that has gathered in the underground pit is then applied to the floating member, and the tide plate rotates together with the floating member and is installed in a standing manner above the soil foundation face, thereby reliably keeping back water.

Moreover, a storage tank is connected to the underground pit for storing water of a constant amount, and a seismograph releasing apparatus is formed on the connecting pipe that connects between the underground pit and the storage tank. Consequently, the seismograph releasing apparatus is operated in an earthquake to make the water stored in the storage tank in advance flow into the underground pit via the connecting pipe. A buoyancy of the water that has gathered in the underground pit is then applied to the floating member, and the tide plate rises together with the floating member and protrudes upward from the soil foundation face, thereby keeping back water.

The tide apparatus in accordance with the present invention is characterized in that the storage tank is formed under the soil foundation face.

In the case in which the storage tank is formed under the soil foundation face as described above, the entrance and exit or the passage are not obstructed, thereby preventing a convenience in utilizing the building from being lost, in the case in which the tide apparatus is not operated under the normal conditions.

Moreover, in the case in which the storage tank is formed under the soil foundation face, the appearance is neat, thereby improving the beauty of the building, and the passage is not obstructed.

The tide apparatus in accordance with the present invention is characterized in that the storage tank is formed over the soil foundation face.

In the case in which the storage tank is formed over the soil foundation face as described above, an amount of water in the storage tank can be less than that in the case in which the storage tank is formed under the soil foundation face, thereby miniaturizing the storage tank.

Moreover, the excavating and burying operations for forming the storage tank under the soil foundation face are not required, thereby suppressing an execution cost.

A tide structure in accordance with the present invention is characterized in that a plurality of the tide apparatuses described above is disposed in parallel.

By such a configuration, water can be kept back in the desired length.

A tide apparatus in accordance with the present invention is characterized by comprising:

an underground pit formed under a soil foundation face;

a water inflow port and a tide plate operation opening for vertically penetrating into a ceiling wall of the underground pit;

a tide plate linked to a floating member at the bottom end thereof in the underground pit for floating together with the floating member by a buoyancy of water; wherein the tide plate can protrude upward from the soil foundation face through the tide plate operation opening by making water flow into the underground pit via the inflow port of the ceiling wall; and a winch for forcibly moving the tide plate up and down.

By forming such a winch, the tide plate can be forcibly pulled down. Consequently, in the case in which the tide plate is pulled down and kept below the soil foundation face by the winch under the normal conditions, the tide plate does not protrude upward from the soil foundation face in normal rainfall, thereby preventing the tide plate from obstructing the passage.

Moreover, even in the case in which the tide plate is protruding upward from the soil foundation face, the operation of forcibly pulling down the tide plate below the soil foundation face by the winch can prevent the state in which the tide plate is kept protruding upward from the soil foundation face and the passage is obstructed, for instance, in rescue in the case in which a disaster occurs.

Furthermore, in the case of a flood or a tsunami in which a large amount of water rapidly surges, the tide plate must be made to protrude upward from the soil foundation face before water is made to flow into the underground pit. Even in this case, the tide plate can be made to protrude upward from the soil foundation face in advance by using a winch, thereby preparing against a tsunami or a flood.

A tide structure in accordance with the present invention is characterized in that a plurality of the tide apparatuses described above is disposed in parallel.

By such ea configuration, water can be kept back in the desired length.

A tide apparatus in accordance with the present invention is characterized by comprising:

an underground pit formed under a soil foundation face;

a water inflow port and a tide plate operation opening for vertically penetrating into a ceiling wall of the underground pit;

a tide plate rotatably mounted in a pivoting manner to one end of the tide plate operation opening;

a floating member located in the underground pit and linked to a surface on the underground pit side of the tide plate via the operation opening; wherein the floating member rises via the tide plate operation opening and rotates the tide plate by making water flow into the underground pit via the inflow port of the ceiling wall, thereby installing the tide plate in a standing manner above the soil foundation face; and a winch for forcibly moving the tide plate up and down.

By forming such a winch, the tide plate can be forcibly pulled down. Consequently, in the case in which the tide plate is pulled down and kept below the soil foundation face by the winch under the normal conditions, the tide plate does not protrude upward from the soil foundation face in normal rainfall, thereby preventing the tide plate from obstructing the passage.

Moreover, even in the case in which the tide plate is protruding upward from the soil foundation face, the operation of forcibly pulling down the tide plate below the soil foundation face by the winch can prevent the state in which the tide plate is kept protruding upward from the soil foundation face and the passage is obstructed, for instance, in rescue in the case in which a disaster occurs.

Furthermore, in the case of a flood or a tsunami in which a large amount of water rapidly surges, the tide plate must be made to protrude upward from the soil foundation face before water is made to flow into the underground pit. Even in this case, the tide plate can be made to protrude upward from the soil foundation face in advance by using a winch, thereby preparing against a tsunami or a flood.

A tide structure in accordance with the present invention is characterized in that a plurality of the tide apparatuses described above is disposed in parallel.

By such a configuration, water can be kept back in the desired length.

A tide apparatus in accordance with the present invention is characterized by comprising:

an underground pit formed under a soil foundation face;

a water inflow port and a tide plate operation opening for vertically penetrating into a ceiling wall of the underground pit;

a tide plate linked to a floating member at the bottom end thereof in the underground pit for floating together with the floating member by a buoyancy of water; wherein the tide plate can protrude upward from the soil foundation face through the tide plate operation opening by making water flow into the underground pit via the inflow port of the ceiling wall;

a storage tank connected to the underground pit for normally storing water of a constant amount;

a connecting pipe for connecting between the underground pit and the storage tank;

a seismograph releasing apparatus formed on the connecting pipe for sensing a shake in an earthquake and for releasing the water stored in the storage tank into the underground pit; and a winch for forcibly moving the tide plate up and down;

wherein the tide plate can protrude upward from the soil foundation face by canceling a lock of the winch and operating the seismograph releasing apparatus in an earthquake to make the water stored in the storage tank flow into the underground pit via the connecting pipe, and the tide plate can be forcibly pulled down by the winch in the state in which the water is made to flow into the underground pit.

As described above, the tide plate is pulled down and kept below the soil foundation face by the winch in normal rainfall in such a manner that the tide plate does not protrude upward from the soil foundation face even in the case in which water is made to flow into the underground pit, thereby preventing the tide plate from obstructing the passage.

Moreover, even in the case in which the tide plate is protruding upward from the soil foundation face, the operation of forcibly pulling down the tide plate below the soil foundation face by the winch can prevent the state in which the tide plate is kept protruding upward from the soil foundation face and the passage is obstructed, for instance, in rescue in the case in which a disaster occurs.

As described above, both the seismograph releasing apparatus and the winch are used. Therefore, even in case the seismograph releasing apparatus is not operated in an earthquake, the tide plate can be reliably pulled up by the winch, thereby preparing against a flood or a tsunami.

The tide apparatus in accordance with the present invention is characterized in that the storage tank is formed under the soil foundation face.

In the case in which the storage tank is formed under the soil foundation face as described above, the entrance and exit or the passage are not obstructed, thereby preventing a convenience in utilizing the building from being lost, in the case in which the tide apparatus is not operated under the normal conditions.

The tide apparatus in accordance with the present invention is characterized in that the storage tank is formed over the soil foundation face.

In the case in which the storage tank is formed over the soil foundation face as described above, an amount of water in the storage tank can be less than that in the case in which the storage tank is formed under the soil foundation face, thereby miniaturizing the storage tank.

Moreover, the excavating and burying operations for forming the storage tank under the soil foundation face are not required, thereby suppressing an execution cost.

A tide structure in accordance with the present invention is characterized in that a plurality of the tide apparatuses defined in any one of the above descriptions is disposed in parallel.

By such a configuration, water can be kept back in the desired length.

A tide apparatus in accordance with the present invention is characterized by comprising:

an underground pit formed under a soil foundation face;

a water inflow port and a tide plate operation opening for vertically penetrating into a ceiling wall of the underground pit;

a tide plate rotatably mounted in a pivoting manner to one end of the tide plate operation opening;

a floating member located in the underground pit and linked to a surface on the underground pit side of the tide plate via the operation opening; wherein the floating member rises via the tide plate operation opening and rotates the tide plate by making water flow into the underground pit via the inflow port of the ceiling wall, thereby installing the tide plate in a standing manner above the soil foundation face;

a storage tank connected to the underground pit for normally storing water of a constant amount;

a connecting pipe for connecting between the underground pit and the storage tank;

a seismograph releasing apparatus formed on the connecting pipe for sensing a shake in an earthquake and for releasing the water stored in the storage tank into the underground pit; and a winch for forcibly moving the tide plate up and down;

wherein the tide plate can protrude upward from the soil foundation face by canceling a lock of the winch and operating the seismograph releasing apparatus in an earthquake to make the water stored in the storage tank flow into the underground pit via the connecting pipe, and the tide plate can be forcibly pulled down by the winch in the state in which the water is made to flow into the underground pit.

As described above, the tide plate is pulled down and kept below the soil foundation face by the winch in normal rainfall in such a manner that the tide plate does not protrude upward from the soil foundation face even in the case in which water is made to flow into the underground pit, thereby preventing the tide plate from obstructing the passage.

Moreover, even in the case in which the tide plate is protruding upward from the soil foundation face, the operation of forcibly pulling down the tide plate below the soil foundation face by the winch can prevent the state in which the tide plate is kept protruding upward from the soil foundation face and the passage is obstructed, for instance, in rescue in the case in which a disaster occurs.

As described above, both the seismograph releasing apparatus and the winch are used. Therefore, even in case the seismograph releasing apparatus is not operated in an earthquake, the tide plate can be reliably pulled up by the winch, thereby preparing against a flood or a tsunami.

The tide apparatus in accordance with the present invention is characterized in that the storage tank is formed under the soil foundation face.

In the case in which the storage tank is formed under the soil foundation face as described above, the entrance and exit or the passage are not obstructed, thereby preventing a convenience in utilizing the building from being lost, in the case in which the tide apparatus is not operated under the normal conditions.

The tide apparatus in accordance with the present invention is characterized in that the storage tank is formed over the soil foundation face.

In the case in which the storage tank is formed over the soil foundation face as described above, an amount of water in the storage tank can be less than that in the case in which the storage tank is formed under the soil foundation face, thereby miniaturizing the storage tank.

Moreover, the excavating and burying operations for forming the storage tank under the soil foundation face are not required, thereby suppressing an execution cost.

A tide structure in accordance with the present invention is characterized in that a plurality of the tide apparatuses defined in any one of the above descriptions is disposed in parallel.

By such a configuration, water can be kept back in the desired length.

By the present invention, the tide plate can be automatically installed in order to reliably keep back water in overhead flooding or the like without depending on power such as human power and electricity, and the tide plate can be installed in advance in order to reliably keep back water in overhead flooding or the like even in the case in which a large amount of water flows once and for all due to a collapse of a levee or a tsunami caused by an earthquake.

Moreover, the present invention can provide a tide apparatus in which the tide plate is not operated in the case of a normal rainfall to prevent the passage from being obstructed.

Furthermore, the present invention can provide a tide apparatus in which the tide plate that has protruded upward from the soil foundation face can be immediately pulled below the soil foundation face, thereby preventing the passage from being obstructed in the case in which a disaster occurs.

BEST MODE OF CARRYING OUT THE INVENTION

An embodiment (example) of the present invention will be described below in detail with reference to the drawings.

Figure 1:
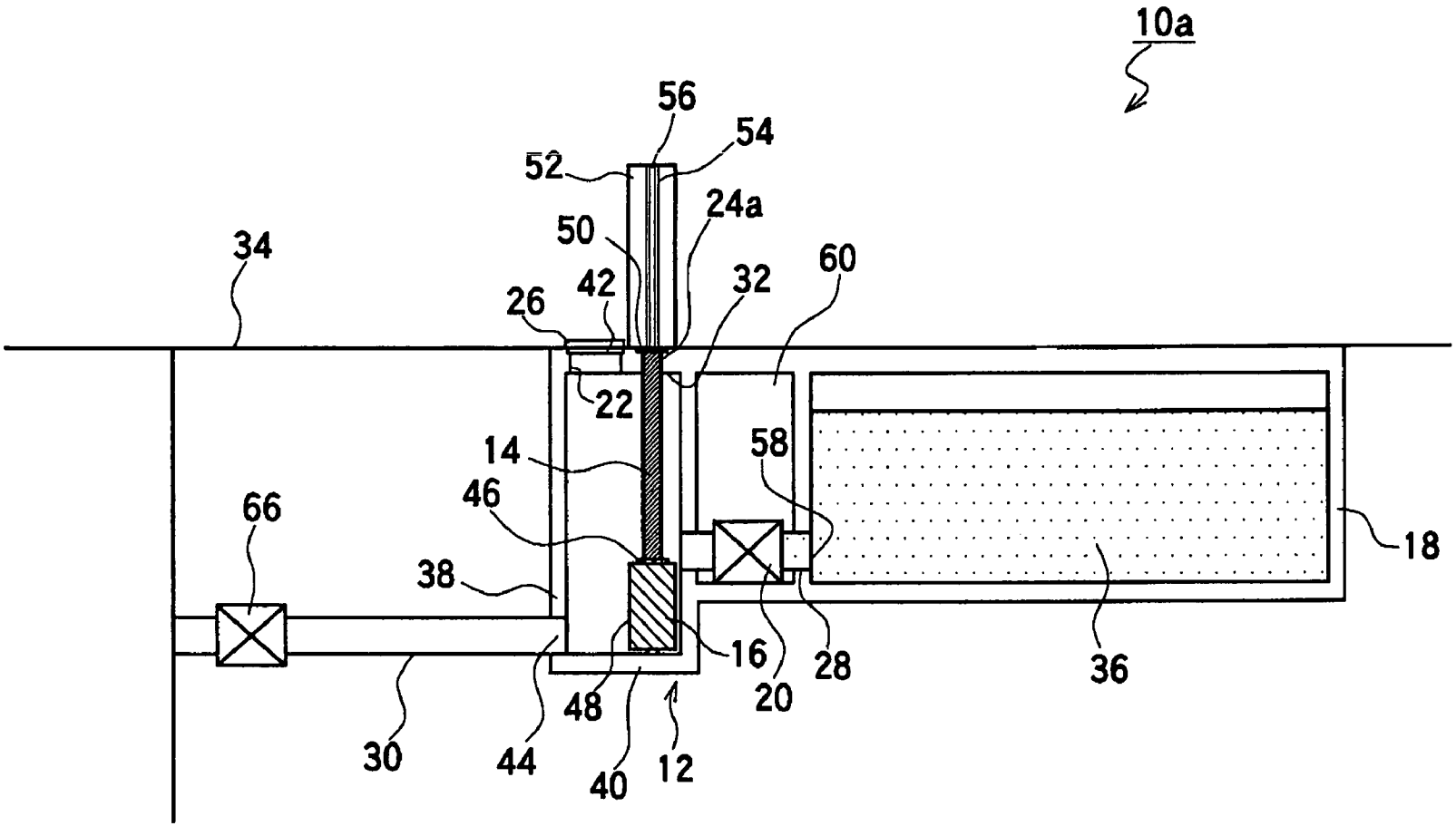
FIG. 1 is a schematic cross-sectional view showing a normal state of a first embodiment of a tide apparatus in accordance with the present invention.
Figure 2:
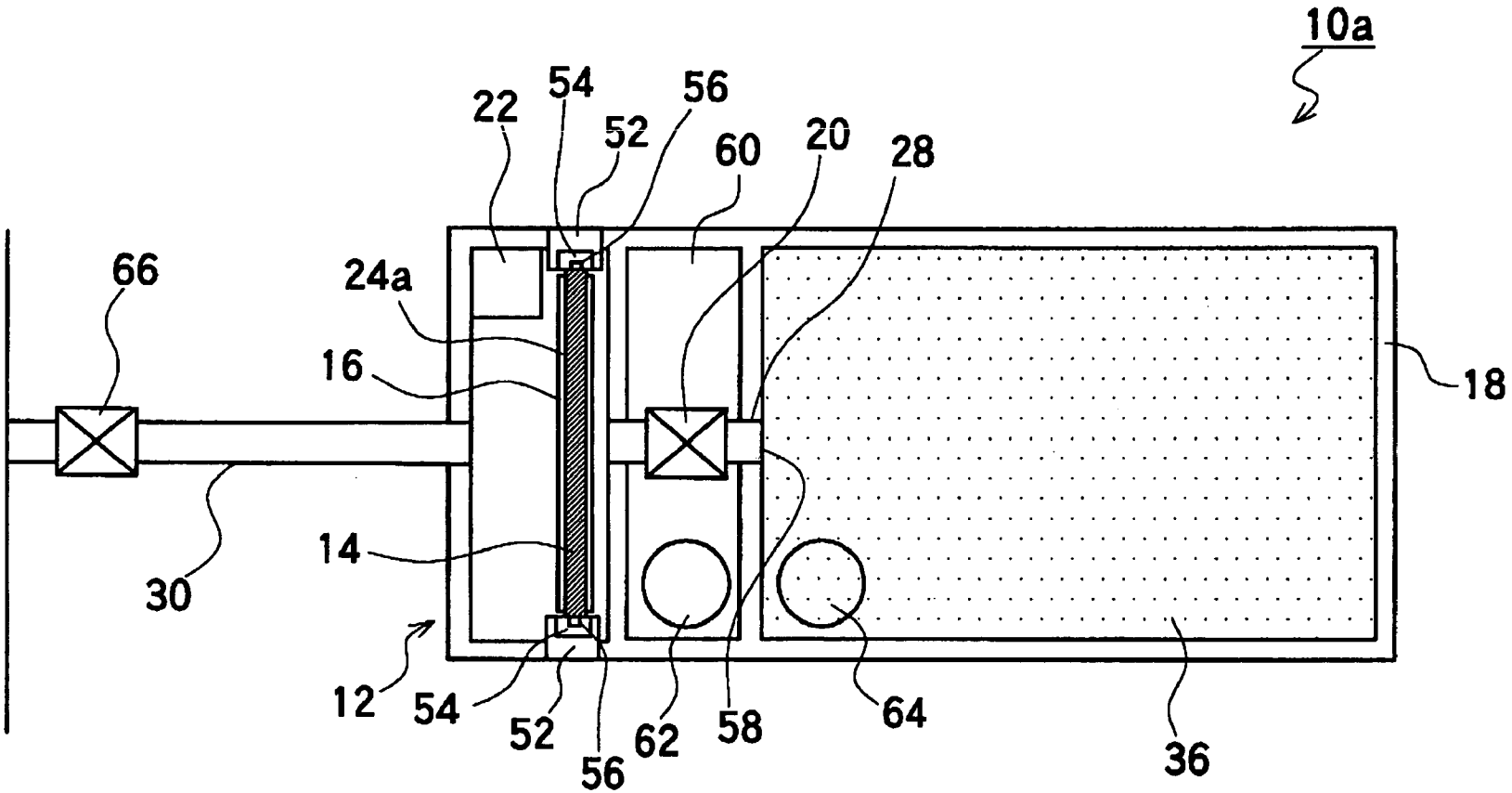
FIG. 2 is a top view showing the tide apparatus of FIG. 1.
Figure 3:
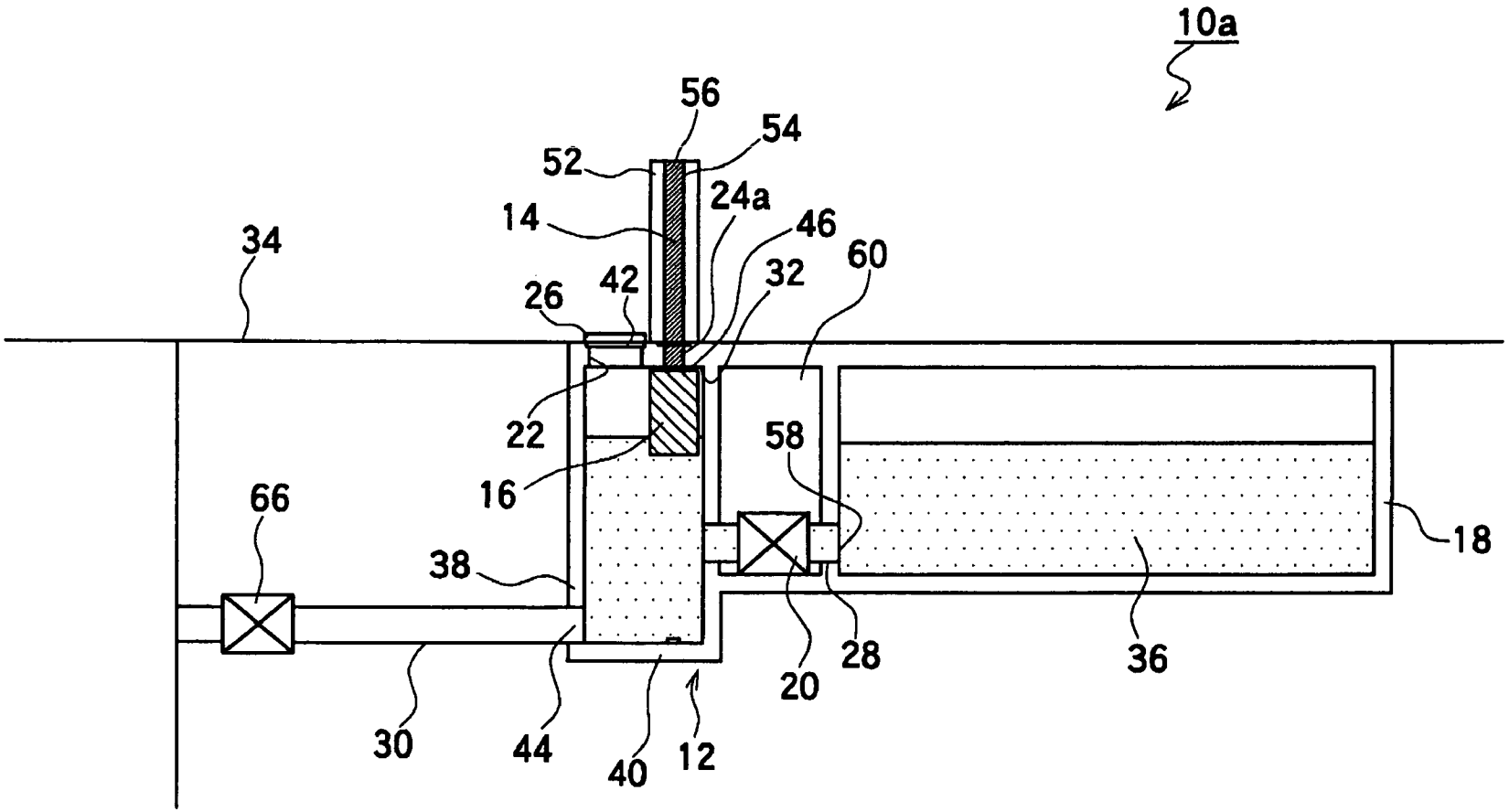
FIG. 3 is a schematic cross-sectional view showing a state in overhead flooding for the tide apparatus of FIG. 1.
Figure 4:
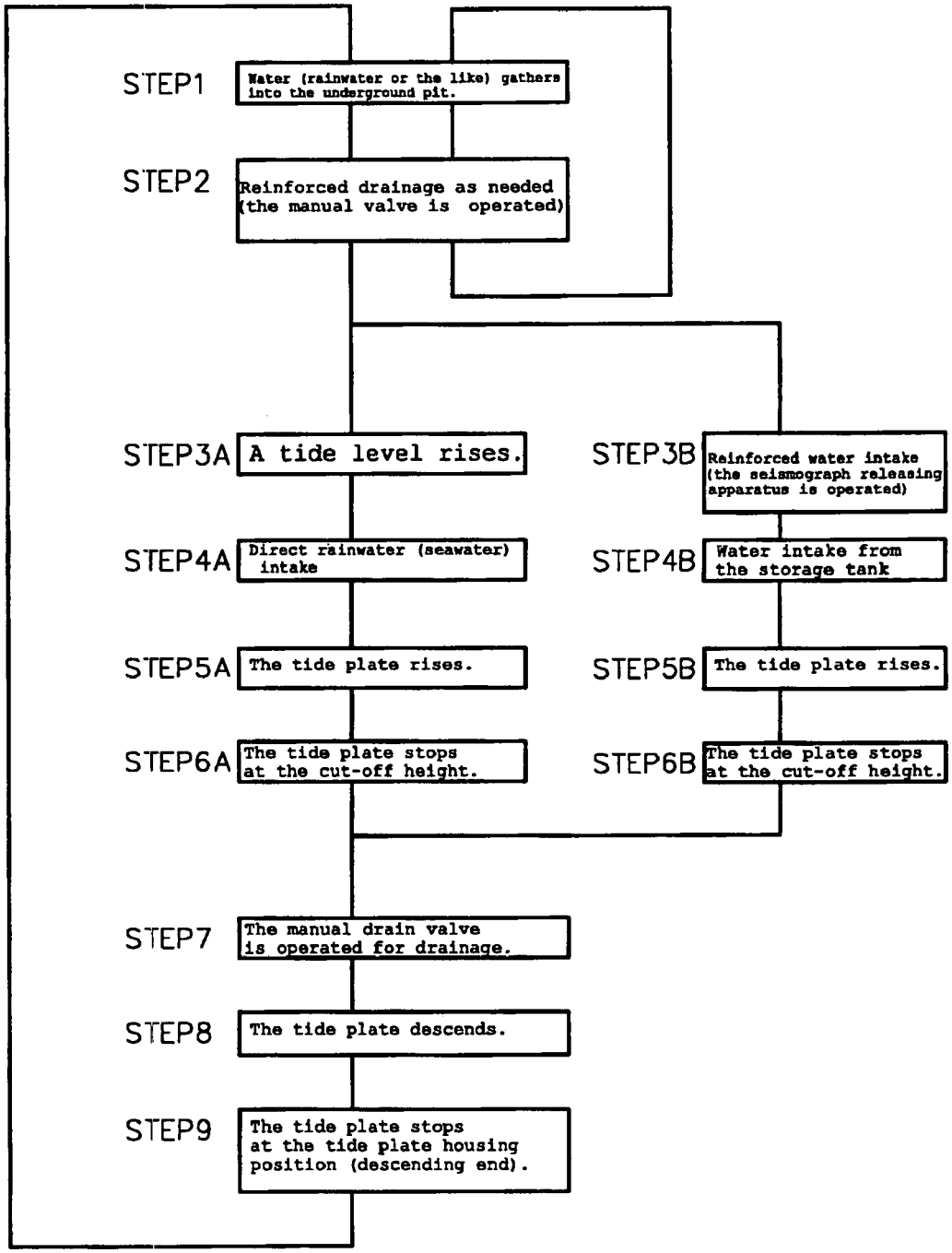
FIG. 4 is a process drawing of a first embodiment of a tide apparatus in accordance with the present invention.
Figure 5:
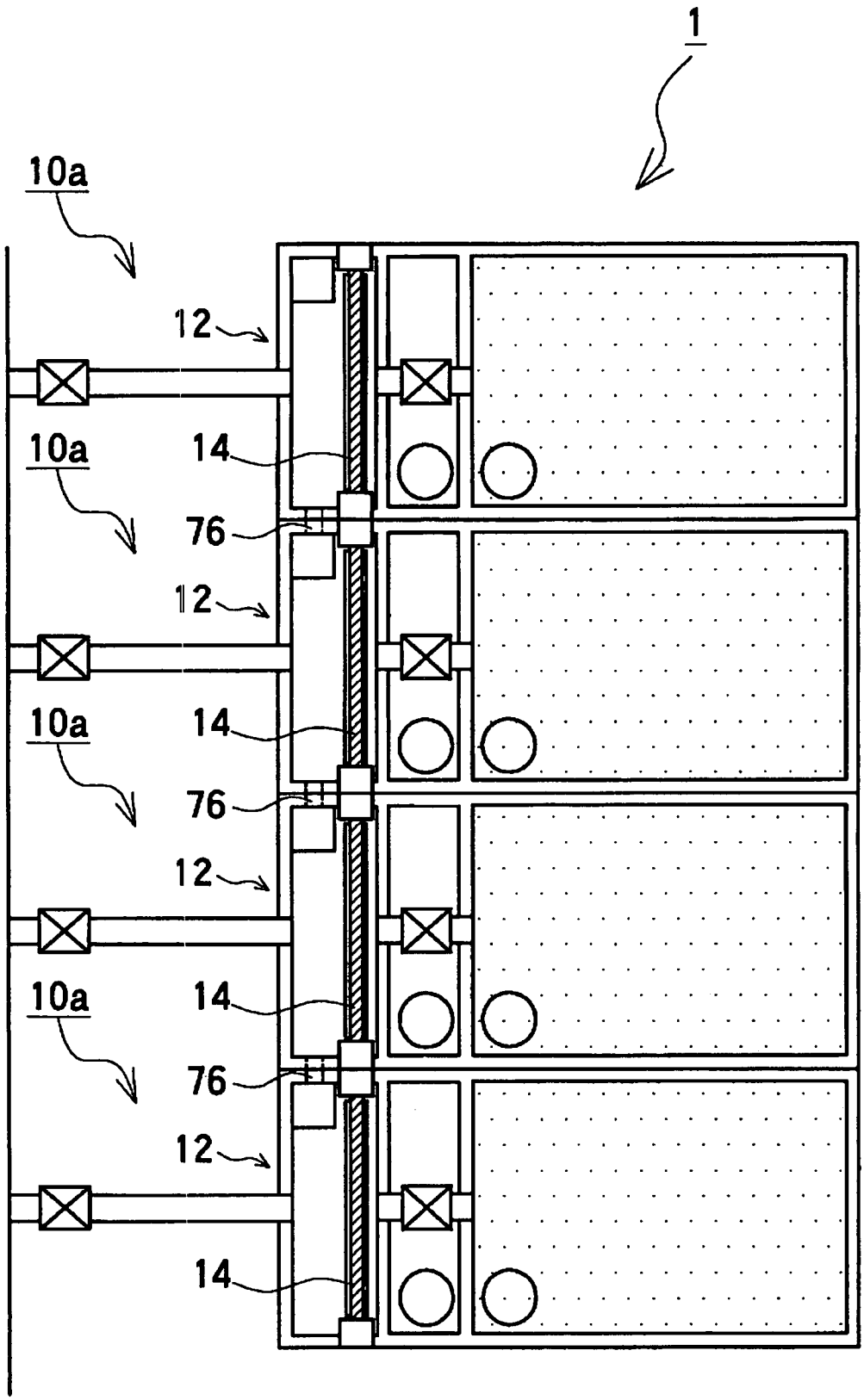
FIG. 5 is a schematic view showing a tide structure including the tide apparatus of FIG. 2.

FIG. 1 is a schematic cross-sectional view showing a normal state of a first embodiment of a tide apparatus in accordance with the present invention. FIG. 2 is a top view showing the tide apparatus of FIG. 1. FIG. 3 is a schematic cross-sectional view showing a state in overhead flooding for the tide apparatus of FIG. 1. FIG. 4 is a process drawing of a first embodiment of a tide apparatus in accordance with the present invention. FIG. 5 is a schematic view showing a tide structure including the tide apparatus of FIG. 2.

A numeral 10*a* represents a tide apparatus as a whole.

FIG. 1 shows a first embodiment of the tide apparatus 10*a* in accordance with the present invention. In the figure, an underground pit 12 made of a reinforced concrete for instance is formed under a soil foundation face 34.

The underground pit 12 is formed by a ceiling wall 32, a peripheral wall 38, and a bottom wall 40 in a closed box pattern. As a matter of course, the underground pit 12 can be made of a metal in the case of a small scale one.

In the ceiling wall 32 of the underground pit 12, there are formed a water inflow port 22 vertically penetrating in a rectangular shape and a tide plate operation opening 24*a* extending in a length direction of the tide plate to the almost total length.

Moreover, in the bottom wall 40, a drain port 44 in a funnel shape is formed for draining water in the underground pit 12, and is connected to a drain pipe 30.

A manual drain valve 66 is formed on the drain pipe 30. Water 36 can be drained from the underground pit 12 by opening the manual drain valve 66.

A storage tank 18 is buried next to the underground pit 12 for always storing the water 36 of a constant amount. A storage water outflow port 58 is formed at the bottom edge portion of the storage tank 18. One edge portion of a connecting pipe 28 is connected to the storage water outflow port 58, and the other edge portion is connected to the peripheral wall 38 of the underground pit 12 and communicates with the inside of the underground pit 12.

At the almost center of the connecting pipe 28, a seismograph releasing apparatus 20 is formed for sensing a shake in an earthquake and releasing the water 36 stored in the storage tank 18 into the underground pit 12. The connecting pipe 28 and the seismograph releasing apparatus 20 are contained in a seismograph releasing apparatus chamber 60 formed between the underground pit 12 and the storage tank 18.

As shown in FIG. 2, cover members 62 and 64 are mounted on the storage tank 18 and the seismograph releasing apparatus chamber 60 for maintaining and managing the conditions in the storage tank 18 and the seismograph releasing apparatus chamber 60 from the soil foundation face 34. By detaching the cover members 62 and 64, the internal conditions can be confirmed.

The seismograph releasing apparatus 20 having become common property will be simply explained below. In the case in which a seismoscope (not shown) in the seismograph releasing apparatus 20 is operated in an earthquake, a carbonic acid gas in a carbonic acid gas cartridge installed in advance is injected into a cylinder to drive a piston, thereby opening or closing a valve.

In general, two seismoscopes (not shown) are mounted in the seismograph releasing apparatus 20, and the valve is opened only in the case in which both the two seismoscopes (not shown) are operated, thereby preventing a malfunction.

While the seismograph releasing apparatus 20 is not restricted in particular, for instance, the emergency shutoff valve of a seismoscope signal type (manufactured by Tokico Co., Ltd.) can be reliably operated in an earthquake, thereby preventing an infiltration of water in advance.

Moreover, there can also be used an emergency shutoff valve of an electrical signal type in which an electrical signal output from an operation panel enables a solenoid to be operated and a carbonic acid gas is injected into a cylinder to drive a piston, thereby opening a valve, and an emergency shutoff valve of a line pressure signal type in which a line pressure of a pipe is introduced to a pressure receiving portion and an increase in a line pressure up to the specified pressure or higher causes a carbonic acid gas to be injected into a cylinder to drive a piston, thereby opening a valve. The above valves can be selected as needed depending on an environment in which the valve is installed.

Since a carbonic acid gas cartridge is used as a driving source for the seismograph releasing apparatus 20, the seismograph releasing apparatus 20 can be installed on a site and under the conditions devoid of a power source such as electricity, and can be reliably operated even in an emergency.

The water inflow port 22 is also used as an inspection port for inspecting the inside of the underground pit 12. A grating 42 is mounted on the top of the water inflow port, and a cover plate 26 for protection from rain is disposed on the grating 42.

The cover plate 26 for protection from rain prevents the grating 42 from being directly exposed to the rain, thereby preventing water from gathering into the underground pit 12 due to a rainfall. However, the cover plate 26 is not necessary in particular in the case in which water flowing into the underground pit 12 in a normal rainfall is exhausted by opening the manual drain valve 66.

A tide plate 14 in a flat plate shape made of a metal flash panel is housed in the underground pit 12 in a state of an insertion into a tide plate operation opening 24*a*. A floating member 16 is linked to the bottom edge of the tide plate 14 via a pedestal 46.

The floating member 16 is formed by injecting a substance having a small specific gravity such as urethane foam into a hollow body made of a fiber-glass reinforced plastic (FRP), a plastic, a metal or the like. By this configuration, even in the case in which a hole is formed in the hollow body, no water infiltrates inside the hollow body, and the floating member floats on the water together with the tide plate 14.

Moreover, the peripheral portion of the floating member is reinforced by a metal angle 48 in such a manner that the floating member is not crushed by a dead load.

The top end of the tide plate 14 is in the plane almost equivalent to the soil foundation face 34, and is provided with a metal cover plate 50 for covering the almost entire opening portion of the tide plate operation opening 24*a*. Persons can easily walk on the cover plate 50.

As shown in FIG. 2, a pair of columns 52 is formed in an integrating manner with the underground pit 12 at the side of the tide plate operation opening 24*a* on the top face of the ceiling wall 32 of the underground pit 12. A depression 54 is formed on the plane facing to each other of the columns 52 for connecting with the edge portion of the tide plate operation opening 24*a*. A rail 56 extending vertically is formed in the depression 54 and the edge portion of the tide plate operation opening 24*a*. While a distance between the columns 52 of a pair is not restricted in particular, it is preferable to form the columns 52 at a distance in which the walking is not obstructed under the normal conditions.

The both side edge portions of the tide plate 14 are disposed in the rails 56. A face of a rail 56 facing to the surface of the tide plate 14 is a tapered face in such a manner that a distance between the rails at a higher position gradually becomes smaller, and a rubber packing (not shown) vertically extending to the entire length of the rail is mounted on a face of the other rail 56.

By this configuration, as the tide plate 14 rises, the tide plate 14 is gradually pressed to the rubber packing (not shown) by the tapered face, thereby press-fitting the rubber packing (not shown) and the tide plate 14 to each other.

The following describes the operating conditions of the first embodiment of the tide apparatus 10*a* in accordance with the present invention.

As shown in FIG. 3, in the case in which a seismoscope (not shown) of the seismograph releasing apparatus 20 senses a shake of a previously specified level in an earthquake, a carbonic acid gas is injected into a cylinder from a carbonic acid gas cartridge, thereby opening a valve.

Subsequently, water that has been stored in the storage tank 18 flows through the pipe 28 and gradually gathers into the underground pit 12. A buoyancy of the water that has gathered is then applied to the floating member 16, and the tide plate 14 rises together with the floating member 16. At this time, the both side edge portions of the tide plate 14 are disposed in the rails 56, and the tide plate 14 rises while being guided by the rails.

In the case in which the underground pit 12 is filled with water, the tide plate 14 rises together with the floating member 16 to the top along the rails 56. A rubber packing (not shown) mounted on the top face of the pedestal 46 then comes closely into contact with the bottom face of the ceiling wall 32, and a rubber packing (not shown) mounted on the rail 56 comes closely into contact with the tide plate 14. Consequently, the tide plate operation opening 24*a* and a gap between the rail 56 and the tide plate 14 are filled, thereby preventing an infiltration of water therefrom.

In the case in which overhead flooding subsides after the tide plate 14 rises, the water in the underground pit 12 is drained externally through the drain port 44 and the drain pipe 30 by opening the manual drain valve 66.

Moreover, the floating member 16 descends together with the tide plate 14 in synchronization with the drainage, and the tide plate 14 is housed underground without protruding upward.

Even in the case in which overhead flooding occurs on the ground due to a flood caused by a heavy rain, the overhead flooding water flows and gradually gathers into the underground pit 12 from the water inflow port 22, thereby operating the tide plate 14 similarly to the above method and preventing an infiltration of water.

The above operating process will be described referring to the process drawing shown in FIG. 4.

For the tide apparatus 10*a* in accordance with the present invention, rainwater flows into the underground pit 12 from the inflow port 22 formed in the ceiling wall 32 of the underground pit 12 under the normal conditions (see STEP 1).

The rainwater that has flown into the underground pit 12 is drained from the pipe by opening the manual drain valve 66 (see STEP 2).

In the case in which overhead flooding occurs on the ground due to a heavy rain, the manual drain valve 66 is closed and rainwater is made to flow into the underground pit 12 (see STEP 3A).

The rainwater is stored in the underground pit 12, thereby raising a tide level in the underground pit 12 (see STEP 4A).

The floating member 16 rises corresponding to a rise of the tide level, and the tide plate 14 gradually protrudes upward from the tide plate operation opening 24*a* (see STEP 5A).

The tide plate 14 stops at the previously specified cut-off height in the underground pit 12, thereby preventing an infiltration of rainwater or the like (see STEP 6A).

On the other hand, in the case in which the seismograph releasing apparatus 20 is operated in an earthquake, a carbonic acid gas is injected into a cylinder (not shown) from a carbonic acid gas cartridge in the seismograph releasing apparatus 20, thereby opening a valve (see STEP 3B).

By opening the valve, the water stored in the storage tank 18 flows through the connecting pipe 28 into the underground pit 12 (see STEP 4B).

The water that has flown into the underground pit 12 raises a tide level in the underground pit 12. The floating member 16 rises corresponding to the rise of the tide level, and the tide plate 14 gradually protrudes upward from the tide plate operation opening 24*a* (see STEP 5B).

The tide plate 14 stops at the previously specified cut-off height, thereby preventing an infiltration of water due to a collapse of a levee or a tsunami caused by an earthquake (see STEP 6B).

In the case in which water cut-off performed by using the tide plate 14 is canceled, the manual drain valve 66 is manually opened again and the water in the underground pit 12 is drained (see STEP 7).

Corresponding to the drainage of the water, the floating member 16 descends downward and the tide plate 14 also descends downward together with the floating member (see STEP 8).

The tide plate 14 stops in the case in which the tide plate 14 descends to a housing position for the tide plate 14 on the bottom wall 40 of the underground pit 12 (see STEP 9).

After the operations from STEP 1 to STEP 9, the similar steps are repeated from STEP 1.

After the seismograph releasing apparatus 20 is operated, the carbonic acid gas cartridge used in STEP 3B can be exchanged to a new carbonic acid gas cartridge depending on a carbonic acid gas capacity in the carbonic acid gas cartridge, thereby repeatedly operating the seismograph releasing apparatus in an earthquake.

For such a tide apparatus 10*a*, as shown in FIG. 5, a tide structure 1 having a long levee of several tens meters, several hundreds meters or longer can be formed by horizontally linking in a plane pattern the tide plates 14 of the tide apparatuses 10*a*.

For the tide structure 1, adjacent underground pits 12 are connected to each other via a communicating pipe 76. Therefore, even in the case in which a seismograph releasing apparatus 20 cannot be operated in some tide apparatus 10*a*, water flows into the underground pit 12 thereof from adjacent another underground pit 12, thereby reliably operating the tide plate 14 and preventing an infiltration of water.

By disposing and utilizing the tide structure 1 in such a manner that a hot spring (open-air bath) on the seaside is surrounded in a place in which the bath sinks in the sea in high tide, the bath is available at any time.

Besides the case of a hot spring, the tide structure can also be used in the case in which seawater is tried to be kept back.

The configuration of a tide apparatus 10*b* and a tide structure 1 shown in FIGS. 6 to 9 is basically equivalent to that of the tide apparatus 10*a* in accordance with the embodiment shown in FIGS. 1 to 5. Consequently, elements equivalent to those illustrated in FIGS. 1 to 5 are numerically numbered similarly and the detailed descriptions of the equivalent elements are omitted.

Figure 6:
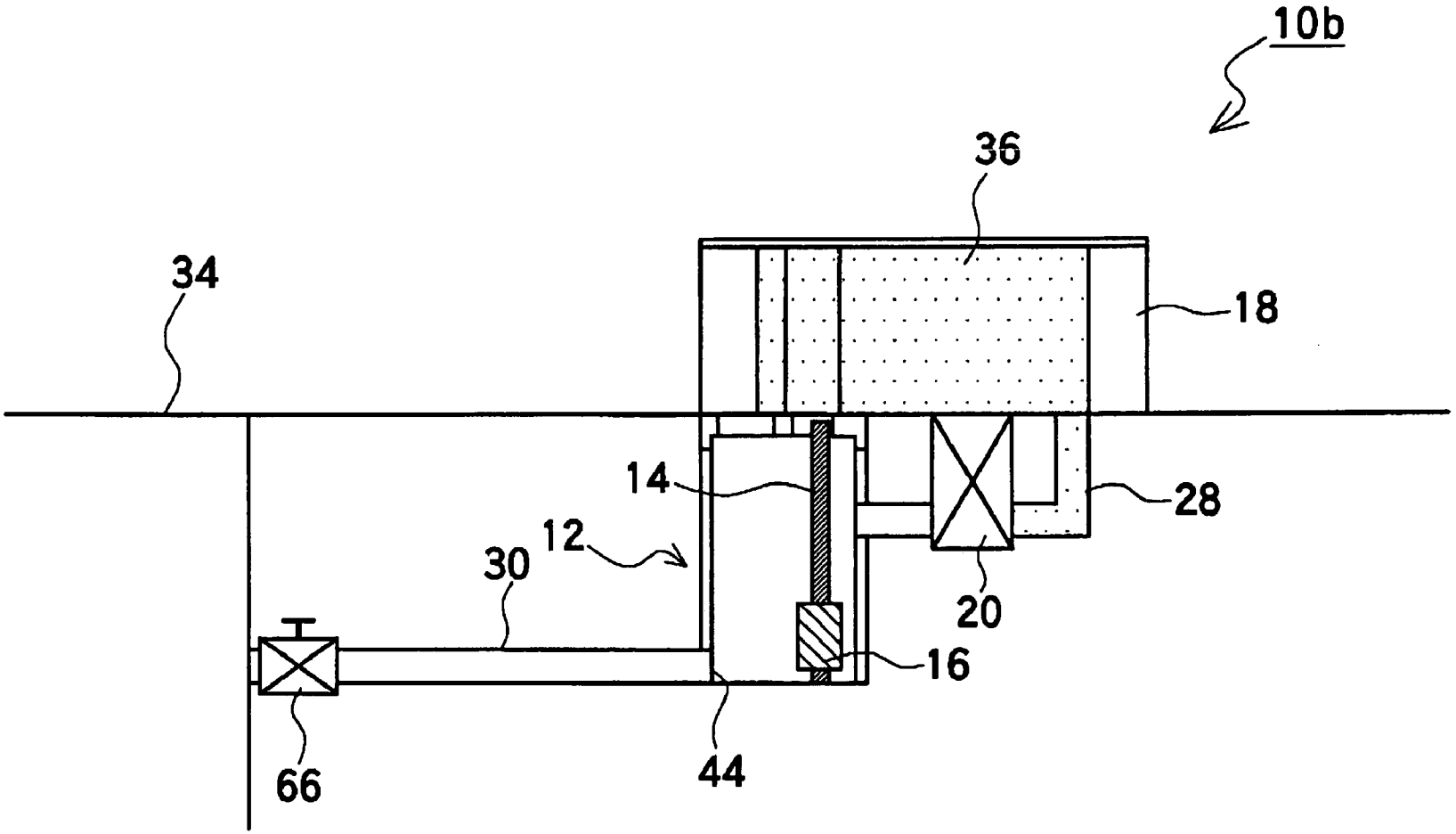
FIG. 6 is a schematic cross-sectional view showing a normal state of a second embodiment of a tide apparatus in accordance with the present invention.
Figure 7:
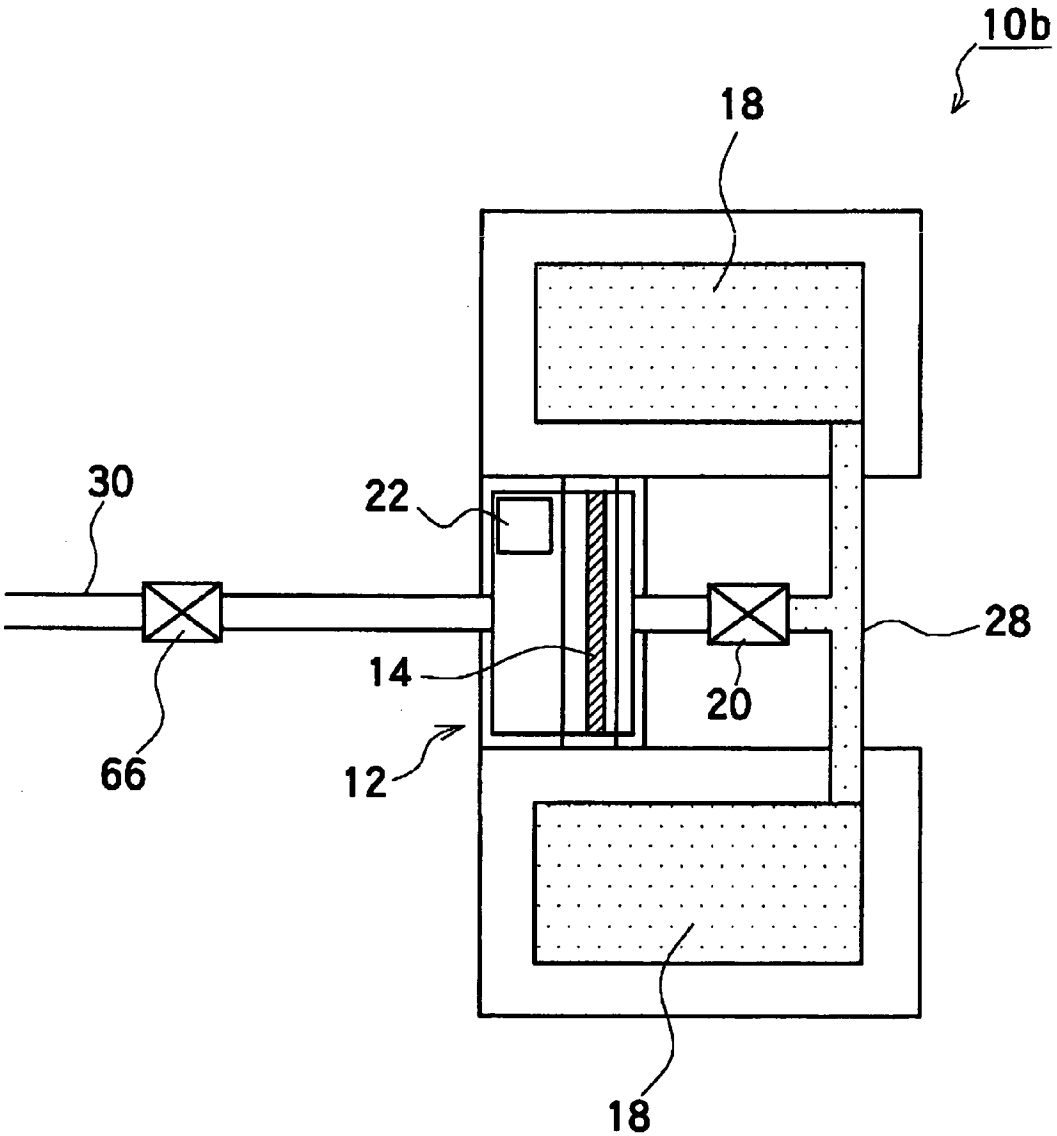
FIG. 7 is a top view showing the tide apparatus of FIG. 6.
Figure 8:
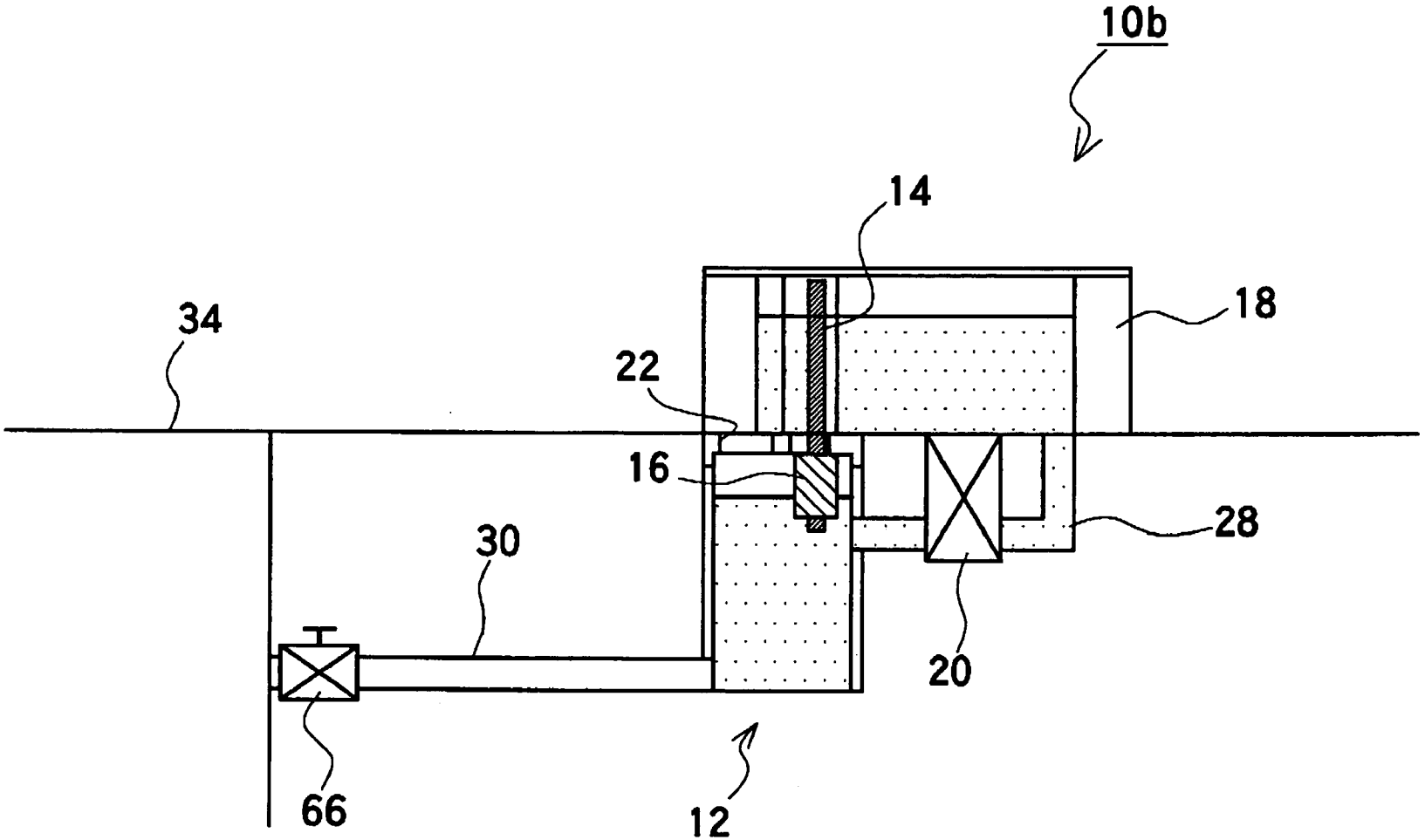
FIG. 8 is a schematic cross-sectional view showing a state in overhead flooding for the tide apparatus of FIG. 6.

For the tide apparatus 10*b* shown in FIGS. 6 to 8, a storage tank 18 for storing the water 36 in advance is formed over the soil foundation face 34.

In the case in which the storage tank 18 is formed over the soil foundation face 34 as described above, all of water in the storage tank 18 can be made to flow into the underground pit 12. Consequently, an amount of water in the storage tank 18 can be less than that in the case in which the storage tank 18 is formed under the soil foundation face 34, thereby miniaturizing the storage tank 18 itself.

Moreover, since the storage tank 18 is not buried, an installing cost can be suppressed as compared with the case in which the storage tank 18 is formed under the soil foundation face 34.

Figure 9:
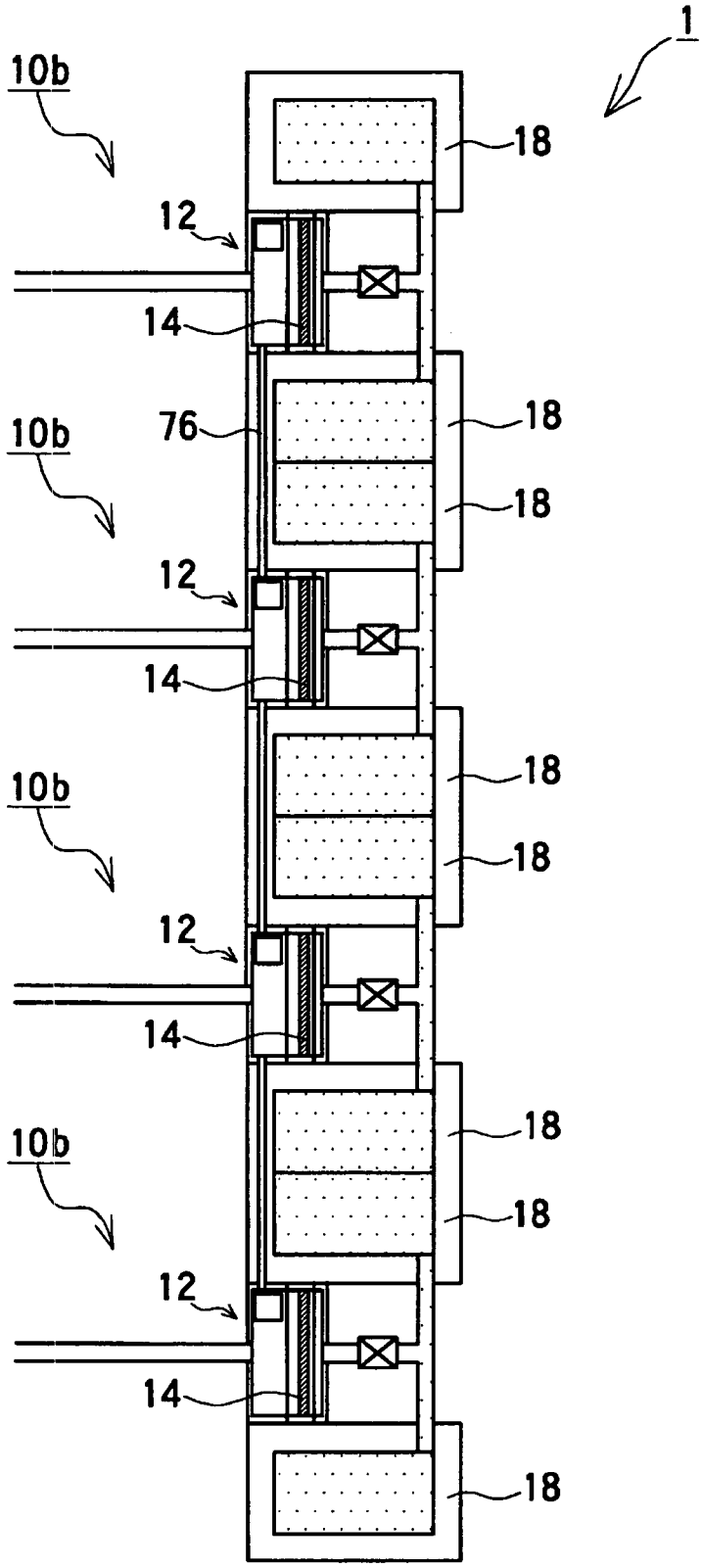
FIG. 9 is a schematic view showing a tide structure including the tide apparatus of FIG. 6.
Figure 10:
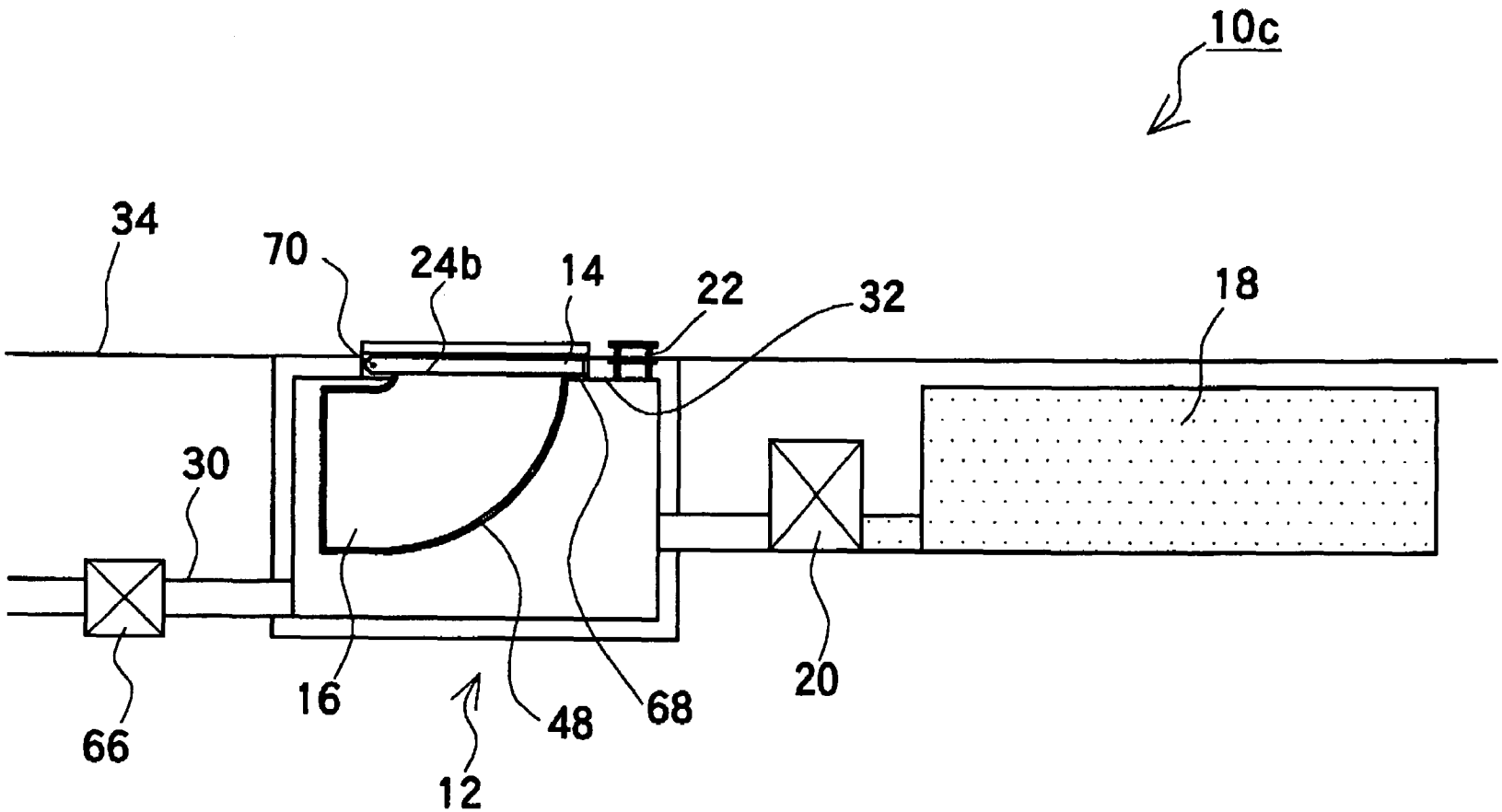
FIG. 10 is a schematic cross-sectional view showing a normal state of a third embodiment of a tide apparatus in accordance with the present invention.

As shown in FIG. 9, a tide structure 1 having a long levee can be formed by horizontally linking in a plane direction the tide plates 14 of the tide apparatuses 10*b* shown in FIGS. 6 to 8.

The configuration of a tide apparatus 10*c* and a tide structure 1 shown in FIGS. 10 to 13 is basically equivalent to that of the tide apparatus 10*a* in accordance with the embodiment shown in FIGS. 1 to 5. Consequently, elements equivalent to those illustrated in FIGS. 1 to 5 are numerically numbered similarly and the detailed descriptions of the equivalent elements are omitted.

For the tide apparatus 10*c* shown in FIGS. 10 to 13, a flange 68 is formed inside the inner periphery of a tide plate operation opening 24*b*, and a tide plate 14 in a flat plate shape made of a metal flash panel is housed in a tide plate housing portion 32 formed at the upper section of the flange 68 in such a manner that the surface of the tide plate 14 and the soil foundation face 34 are in the same plane.

For the tide plate 14, a rotating axis 70 formed on one edge side of the tide plate is rotatably mounted in a pivoting manner to a bearing (not shown) formed on a side wall of the tide plate operation opening 24*b*, thereby enabling the tide plate 14 to be rotated.

One edge side of the tide plate 14 is rounded without an angular corner, thereby enabling the tide plate 14 to smoothly rotates A floating member 16 in a shape in such a manner that a part of a cylinder is cut in a longitudinal direction is linked to a surface on the underground pit 12 side of the tide plate 14 and is located in the underground pit 12 via the tide plate operation opening 24*b*.

Similarly to the tide apparatus 10*a* in accordance with the first embodiment, the floating member 16 is formed by injecting a substance having a small specific gravity such as urethane foam into a hollow body made of a fiber-glass reinforced plastic (FRP), a plastic, a metal or the like. By this configuration, even in the case in which a hole is formed in the hollow body, no water infiltrates inside the hollow body, and the floating member floats on the water together with the tide plate 14.

Moreover, the peripheral portion of the floating member is reinforced by a metal angle 48 in such a manner that the floating member is not crushed by a dead load.

The floating member 16 is housed in the underground pit 12 via the tide plate operation opening 24*b* under the normal conditions. The floating member 16 floats by the water made to flow through an inflow port 22 in overhead flooding, and the tide plate 14 pivots on the rotating axis 70, thereby installing the tide plate L4 in a standing manner above the soil foundation face 34.

For the tide apparatus 10*c*, even in the case in which soil and sand invade into the tide plate operation opening 24*b*, a rise of the tide plate 14 is not obstructed in overhead flooding, as compared with the case in which the tide plate operation opening 24*a* is formed in the ceiling wall 32 of the underground pit 12 and the floating member 16 raises the tide plate 14 via the tide plate operation opening 24*a* by a buoyancy of water.

A pair of columns 52 having a cross section in an L shape is formed in a standing manner on the top face of the ceiling wall 32 of the underground pit 12 at the side of the rotating axis 70 formed on one edge side of the tide plate 14. In the case in which the tide plate 14 pivots and is installed in a standing manner above the soil foundation face, an inner face 74 of a rear wall 72 of the column 52 is abutted to the surface on the ground side of the tide plate 14, thereby keeping back water.

Figure 11:
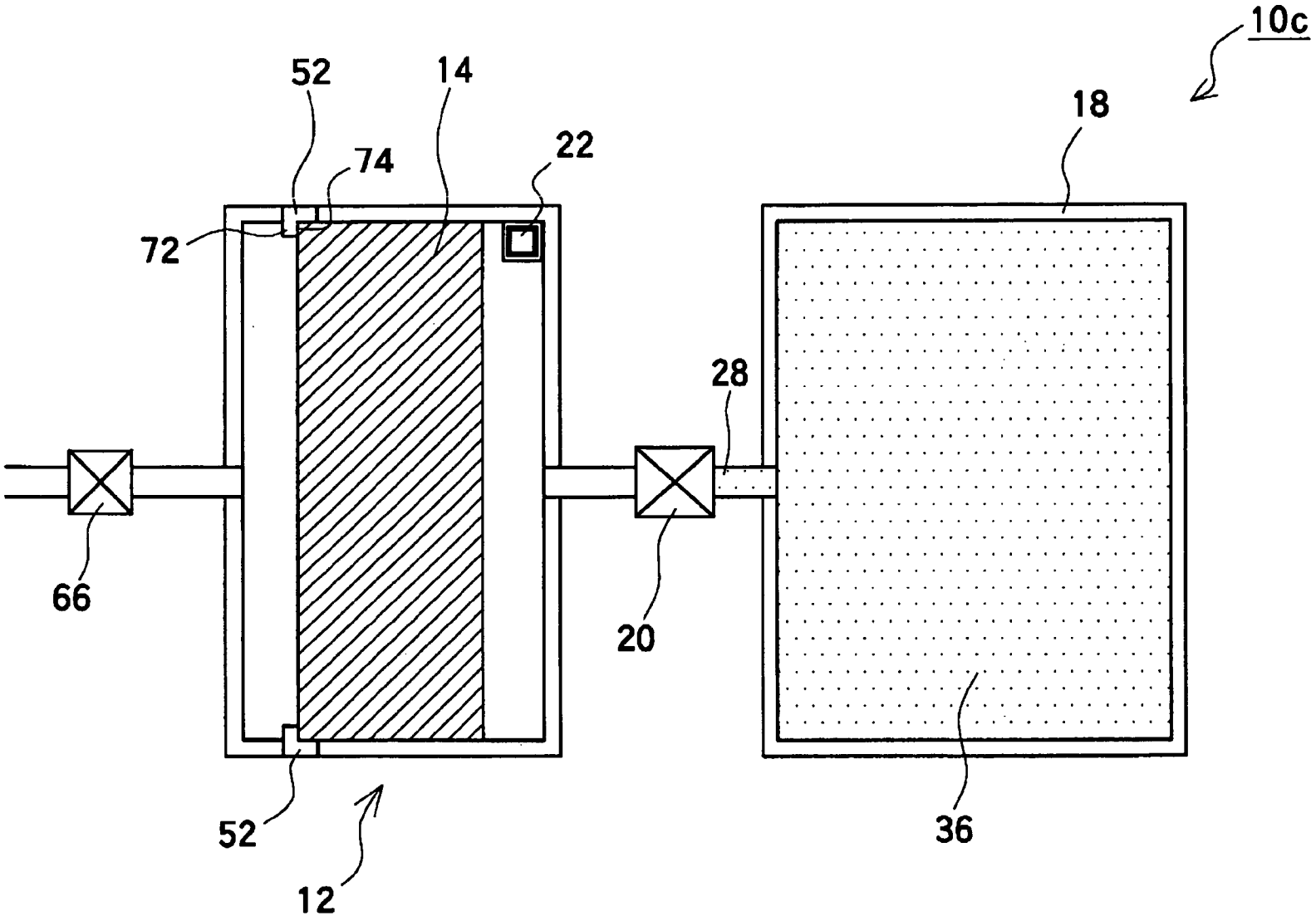
FIG. 11 is a top view showing the tide apparatus of FIG. 10.
Figure 12:
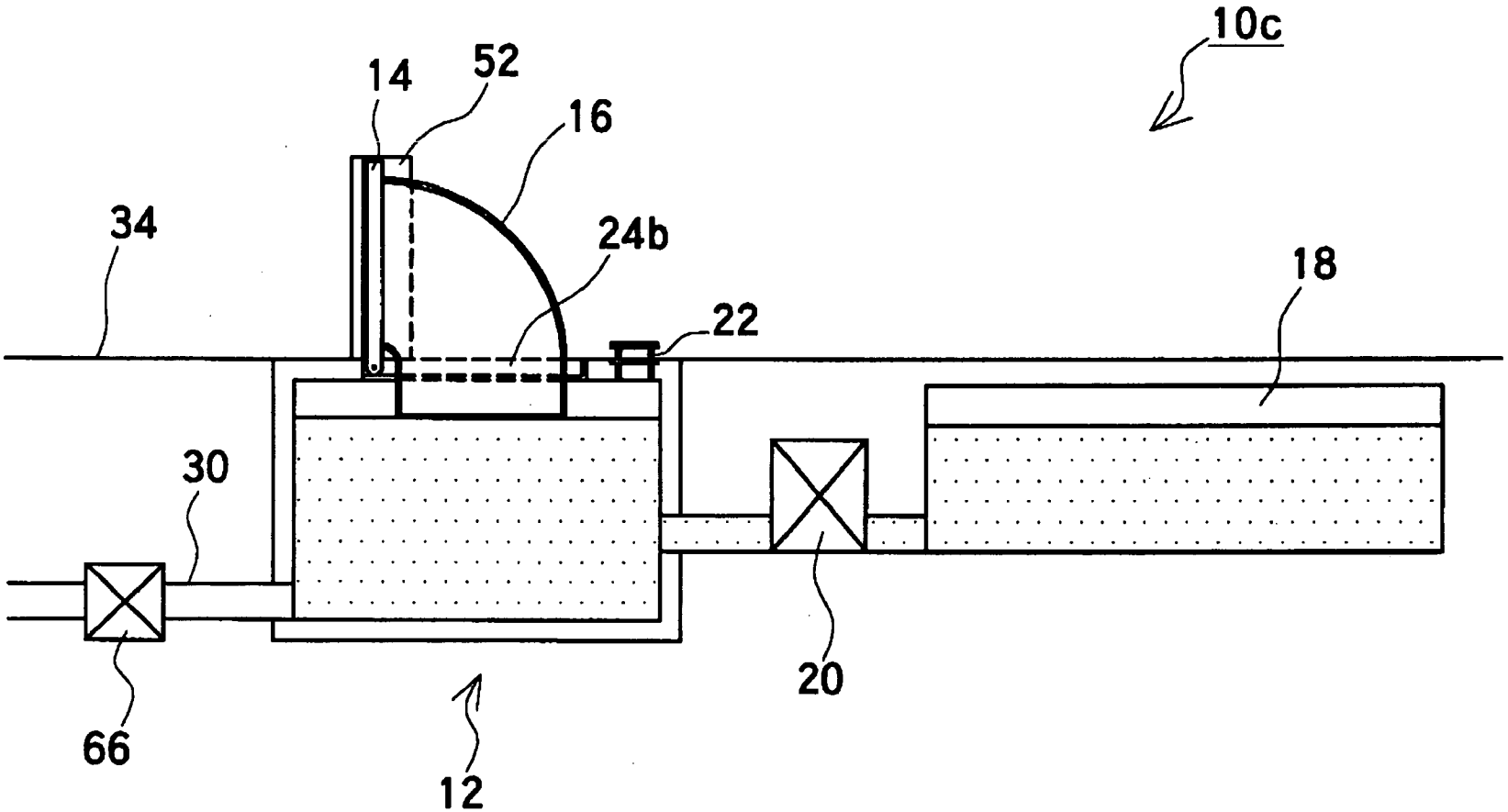
FIG. 12 is a schematic cross-sectional view showing a state in overhead flooding for the tide apparatus of FIG. 10.
Figure 13:
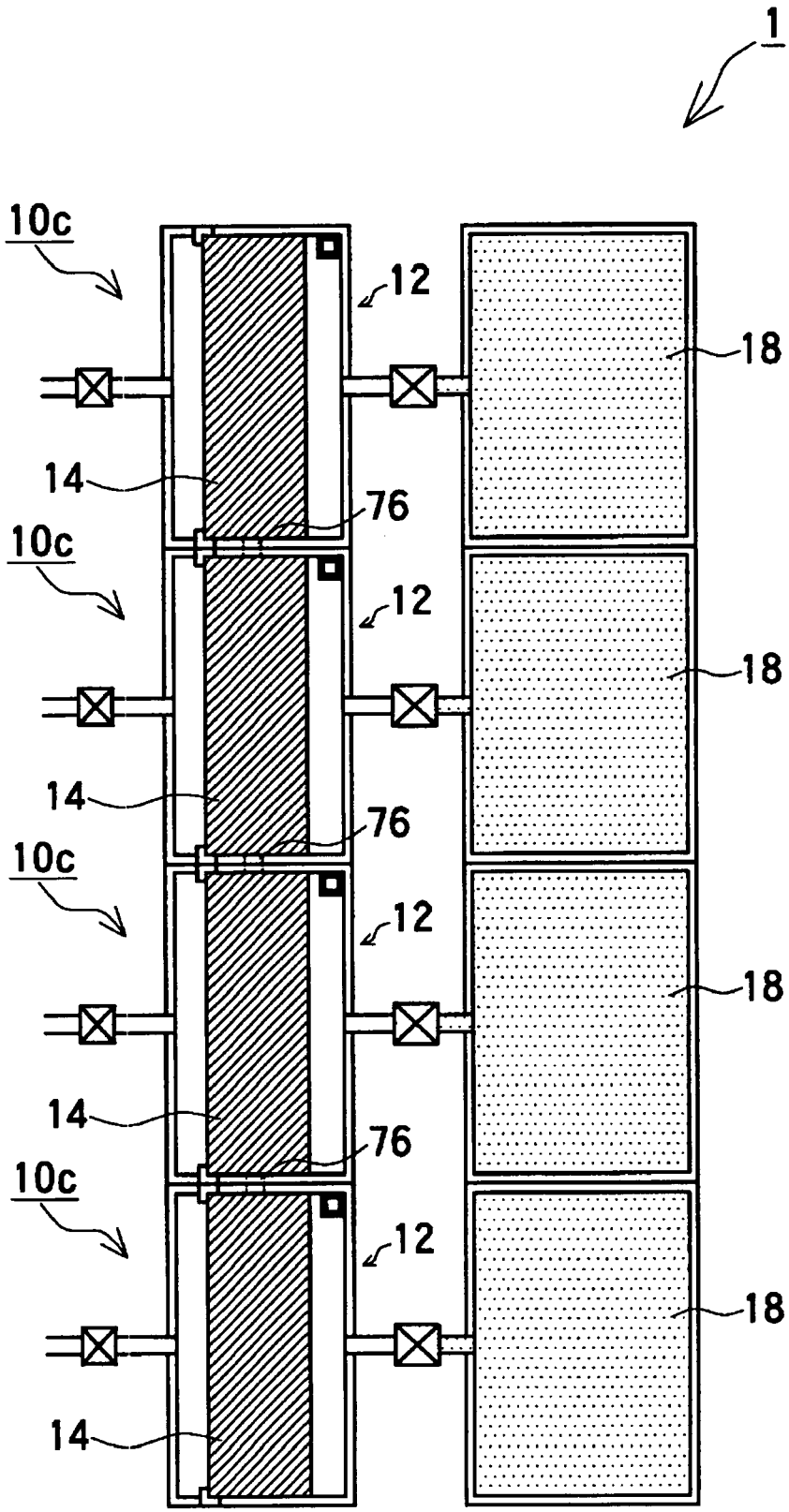
FIG. 13 is a schematic view showing a tide structure including the tide apparatus of FIG. 10.
Figure 14:
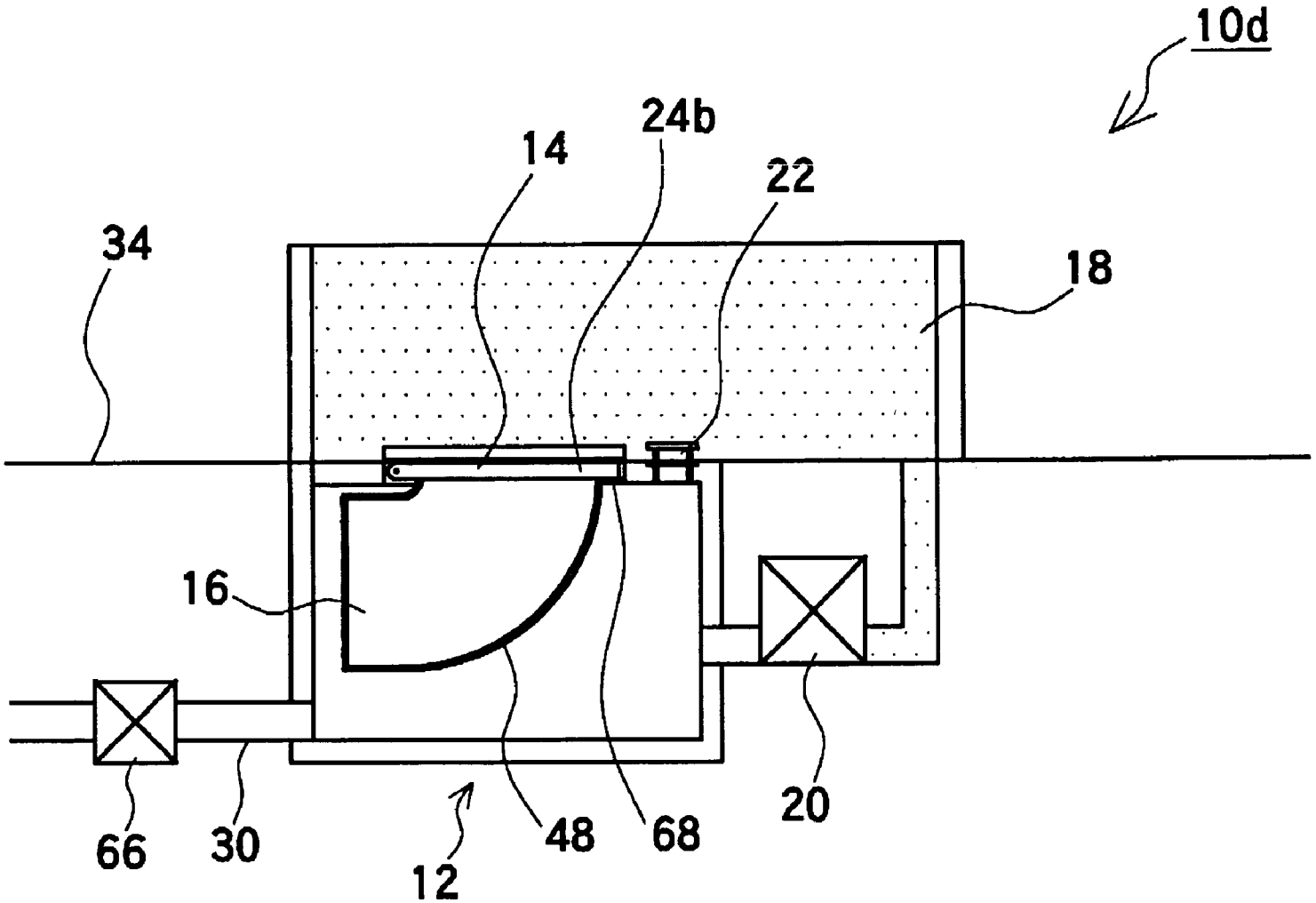
FIG. 14 is a schematic cross-sectional view showing a normal state of a fourth embodiment of a tide apparatus in accordance with the present invention.
Figure 15:
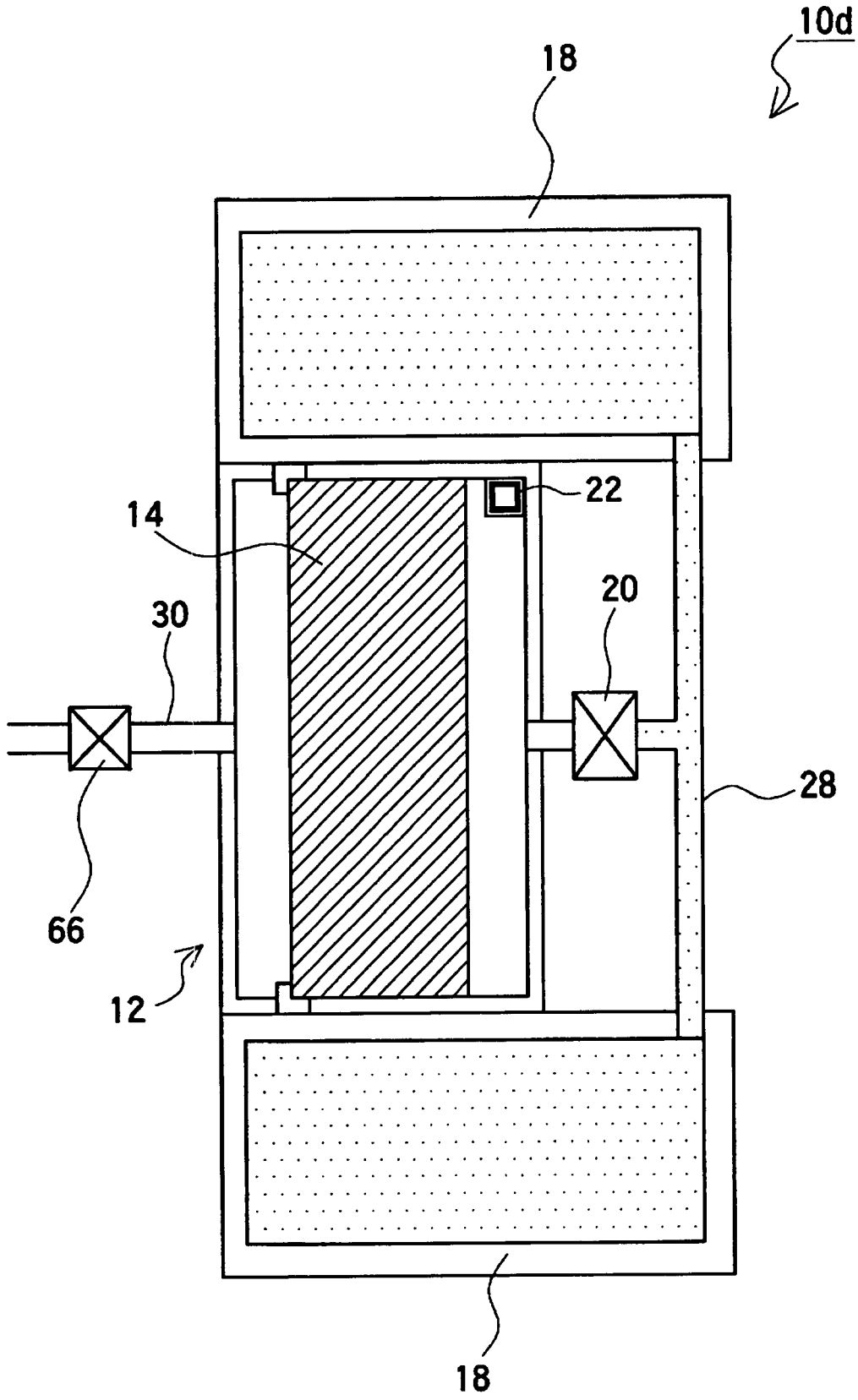
FIG. 15 is a top view showing the tide apparatus of FIG. 14.
Figure 16:
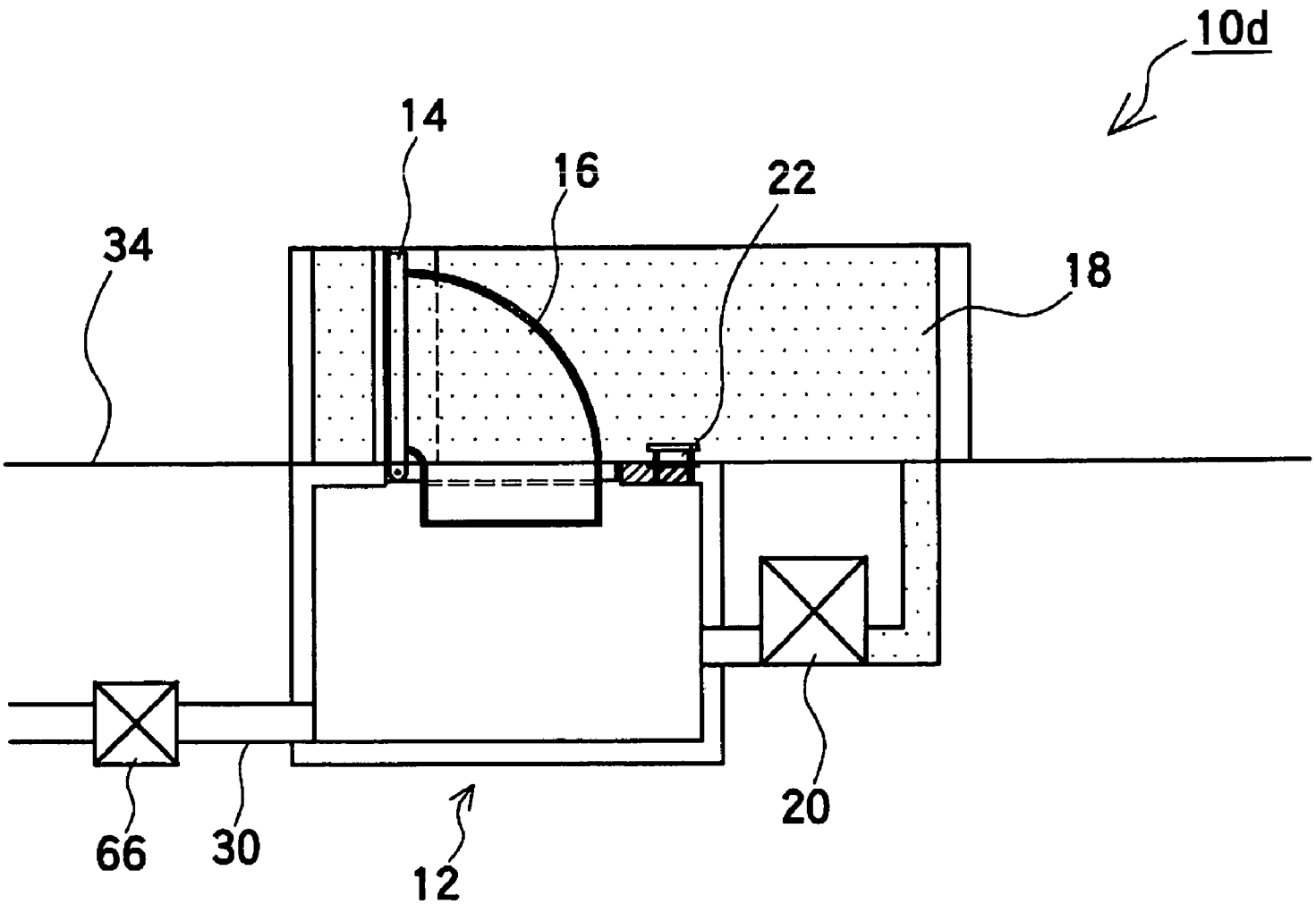
FIG. 16 is a schematic cross-sectional view showing a state in overhead flooding for the tide apparatus of FIG. 14.
Figure 17:
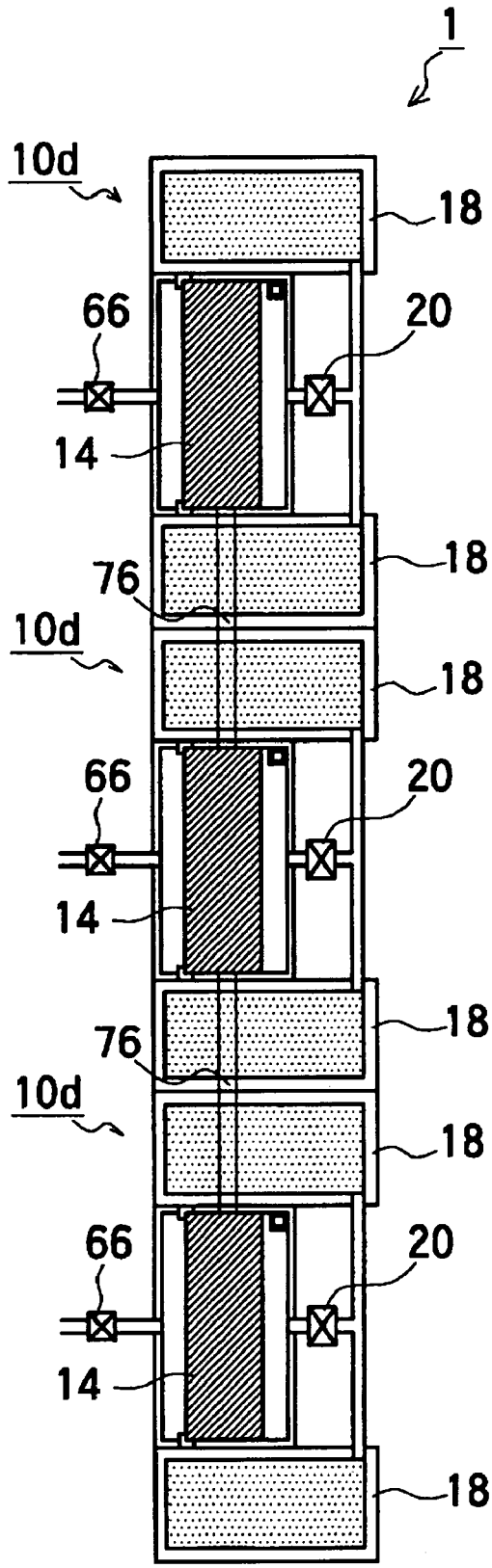
FIG. 17 is a schematic view showing a tide structure including the tide apparatus of FIG. 10.

A rubber packing (not shown) vertically extending is mounted on the inner face 74 of the rear wall 72 of the column 52 and seals up a gap between the tide plate 14 and the column 52, thereby preventing water from infiltrating into an infiltration prevention side (a left side in FIG. 11).

The configuration of a tide apparatus 10*d* and a tide structure 1 shown in FIGS. 14 to 17 is basically equivalent to that of the tide apparatus 10*c* in accordance with the embodiment shown in FIGS. 10 to 13. Consequently, elements equivalent to those illustrated in FIGS. 10 to 13 are numerically numbered similarly and the detailed descriptions of the equivalent elements are omitted.

Similarly to the tide apparatus 10*b* shown in FIGS. 6 to 9, for the tide apparatus 10*d* shown in FIGS. 14 to 17, a storage tank 18 for storing the water in advance is formed over the soil foundation face 34.

In the case in which the storage tank 18 is formed over the soil foundation face 34 as described above, all of water in the storage tank 18 can be made to flow into the underground pit 12. Consequently, an amount of water in the storage tank 18 can be less than that in the case in which the storage tank 18 is formed under the soil foundation face 34, thereby miniaturizing the storage tank 18 itself.

Moreover, since the storage tank 18 is not buried, an installing cost can be suppressed as compared with the case in which the storage tank is formed under the soil foundation face.

Figure 18:
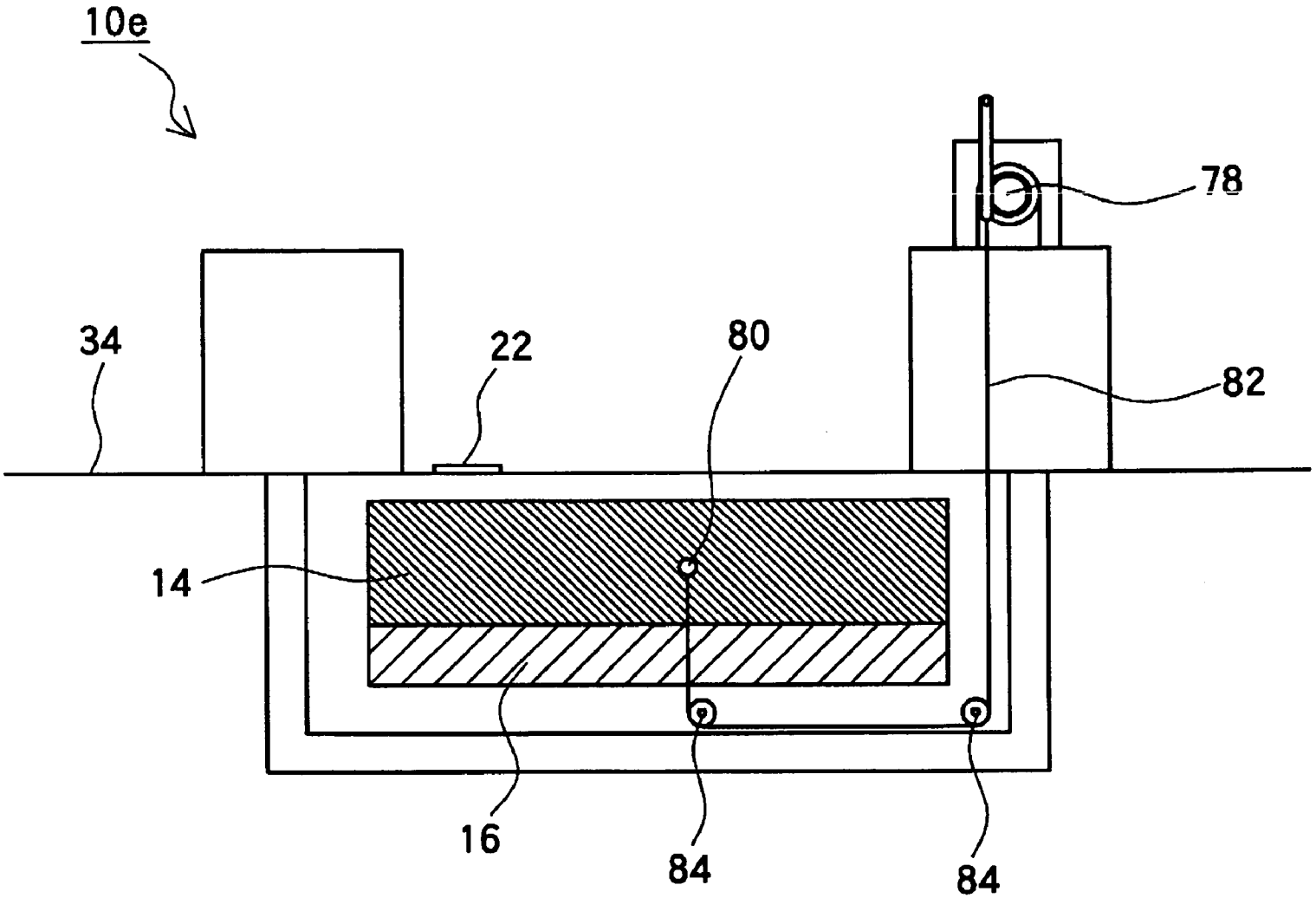
FIG. 18 is a schematic cross-sectional view showing a normal state of a fifth embodiment of a tide apparatus in accordance with the present invention.
Figure 19:
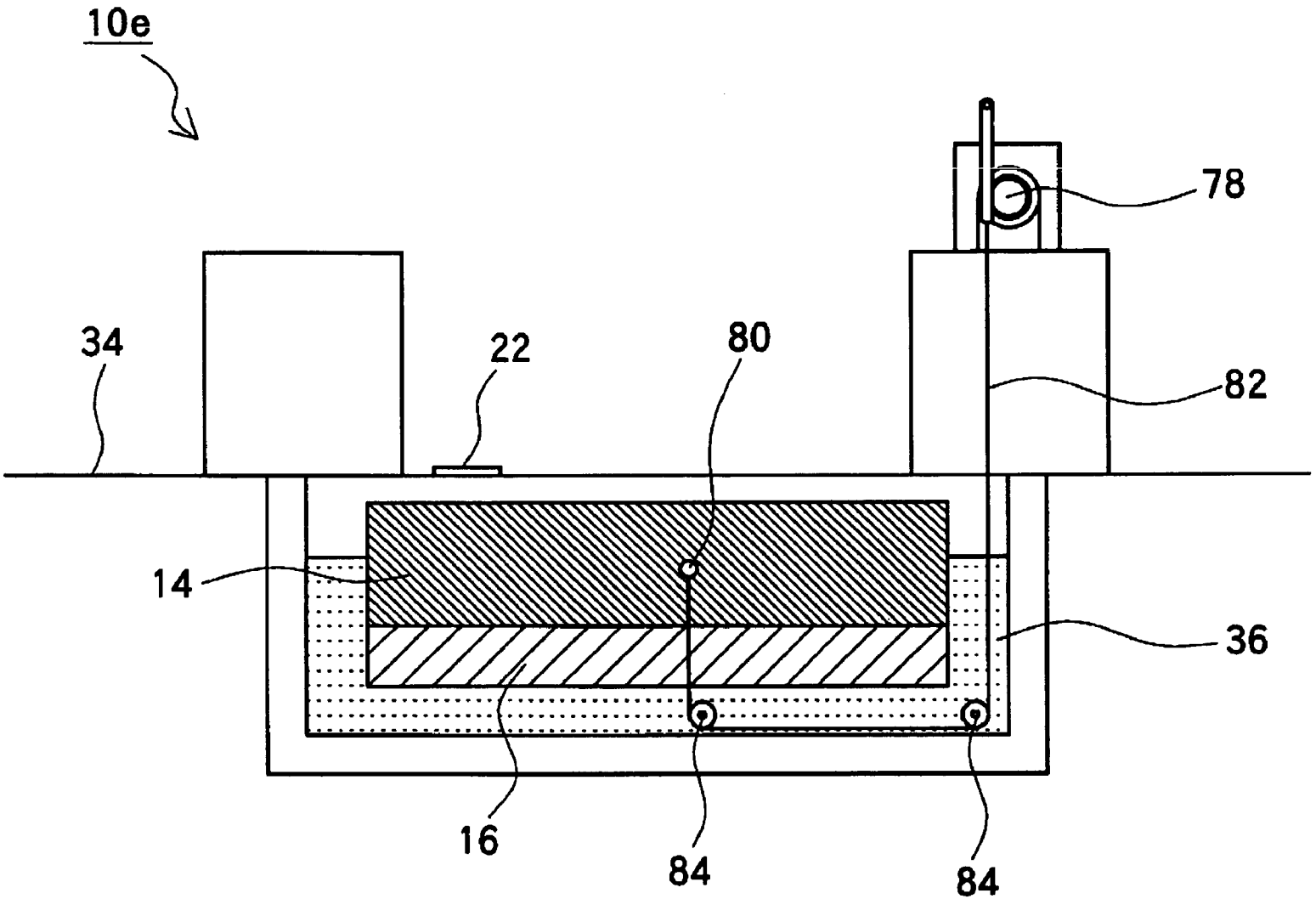
FIG. 19 is a schematic cross-sectional view showing a state in which a winch is operated for the tide apparatus of FIG. 18.

The configuration of a tide apparatus 10*e* shown in FIGS. 18 and 19 is basically equivalent to that of the tide apparatus 10*a* in accordance with the embodiment shown in FIGS. 1 to 3. Consequently, elements equivalent to those illustrated in FIGS. 1 to 3 are numerically numbered similarly and the detailed descriptions of the equivalent elements are omitted.

The tide apparatus 10*e* shown in FIG. 18 is provided with a winch 78 for forcibly pulling down the tide plate 14. While the winch 78 in accordance with the present embodiment has only a function of pulling down the tide plate, the winch 78 and the tide apparatus 10*e* can also be configured for moving the tide plate up and down.

For the tide apparatus 10*e*, one end of a wire 82 is locked to the side face of the tide plate 14 by a locking member 80, and the other end is locked to the winch 78 formed above the soil foundation face 34. The wire 82 disposed between the winch 78 and the locking member 80 is pulled up by the winch 78 via pulleys 84 mounted in the underground pit 12.

For the tide apparatus 10*e* in accordance with the present embodiment, the tide plate 14 is pulled down and kept below the soil foundation face 34 by the winch 78 under the normal conditions. The winch 78 generally has a locking function (not shown), thereby locking the tide plate 14 under the soil foundation face 34.

As shown in FIG. 19, even in the case in which normal rainwater is made to flow into the underground pit 12, the tide plate 14 can be configured to be prevented from protruding upward from the soil foundation face 34.

By this configuration, even in the case in which water is made to flow into the underground pit 12 in normal rainfall and drainage is delayed, the tide plate 14 can be prevented from protruding upward from the soil foundation face 34.

Figure 20:
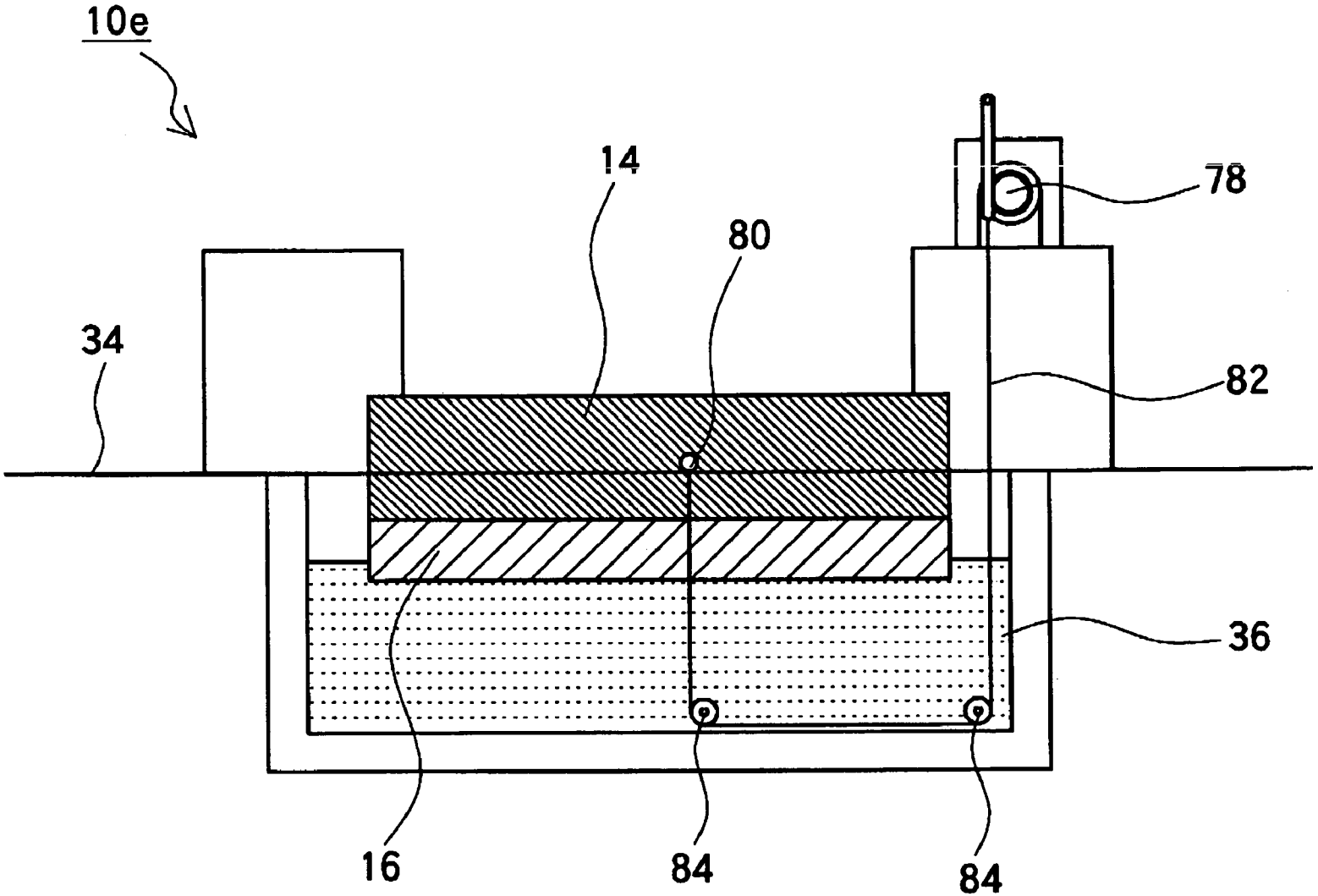
FIG. 20 is a schematic cross-sectional view showing a normal state of a sixth embodiment of a tide apparatus in accordance with the present invention.
Figure 21:
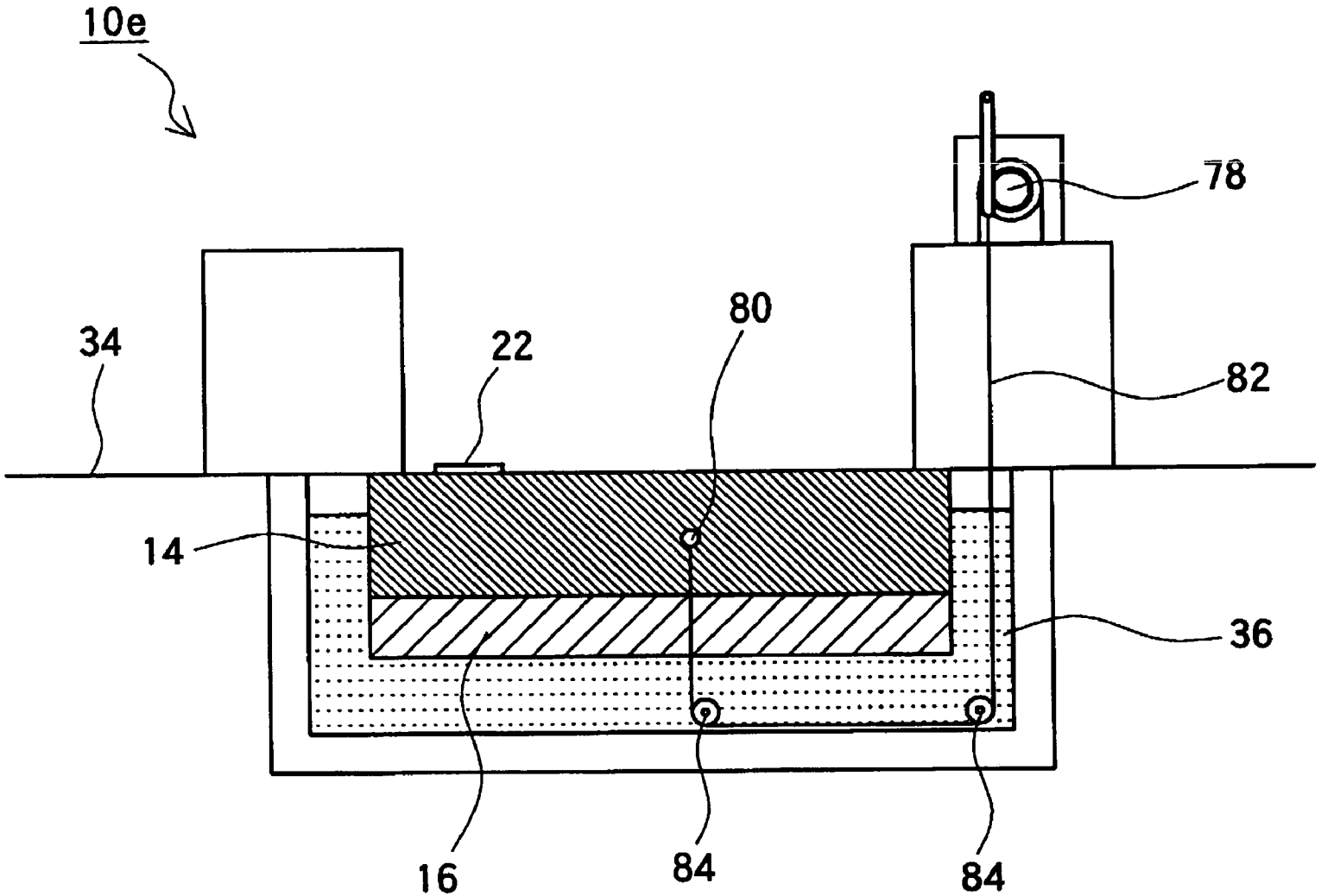
FIG. 21 is a schematic cross-sectional view showing a state in which a winch is operated for the tide apparatus of FIG. 20.

Moreover, in the case in which water has been made to flow into the underground pit 12 and the tide plate 14 has protruded upward from the soil foundation face 34 as shown in FIG. 20, the tide plate 14 can be forcibly housed under the soil foundation face 34 by the winch 78 as shown in FIG. 21 even in the case in which the water remains in the underground pit 12.

As described above, even in the case in which the tide plate 14 is protruding upward from the soil foundation face 34, the operation of forcibly pulling down the tide plate 14 below the soil foundation face 34 by the winch 78 can prevent the state in which the tide plate 14 is kept protruding upward from the soil foundation face 34 and the passage is obstructed, for instance, in rescue in the case in which a disaster occurs.

Moreover, by using a winch capable of moving the tide plate up and down, the tide plate 14 can be made to protrude upward from the soil foundation face 34 before water is made to flow into the underground pit 12, although this is not shown in the figure. Consequently, even in the case of a flood or a tsunami in which a large amount of water rapidly surges, the disaster can be provided against in advance.

While the winch 78 is not restricted in particular, it is preferable to use a manual winch 78, which can be available even in the case in which a disaster occurs.

Moreover, an allowable load of the winch 78 is preferably at least a load that is obtained by subtracting a dead load of the tide plate 14 from the maximum buoyancy of the floating member 16 mounted under the tide plate 14.

Figure 22:
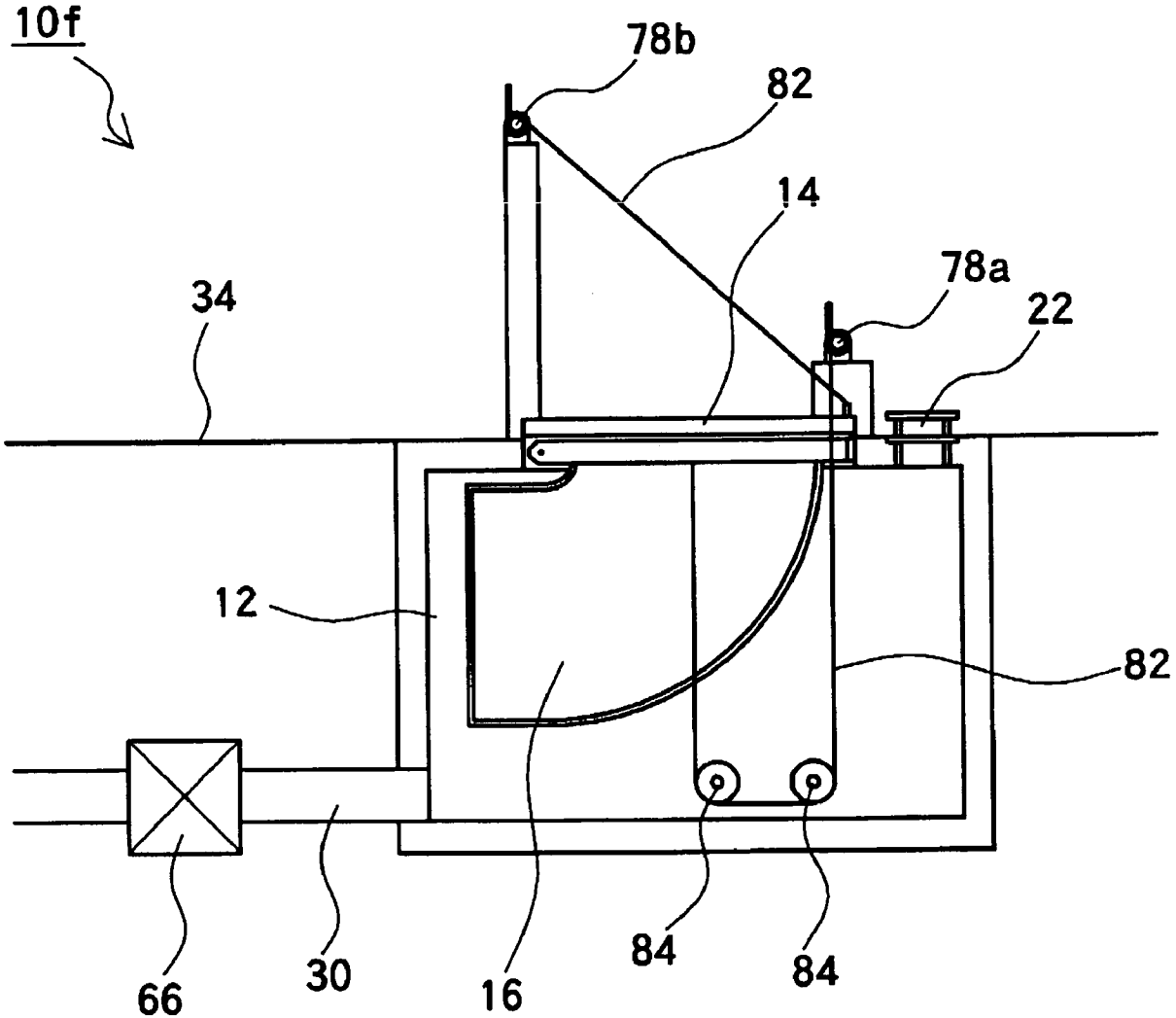
FIG. 22 is a schematic cross-sectional view showing a normal state of a seventh embodiment of a tide apparatus in accordance with the present invention.
Figure 23:
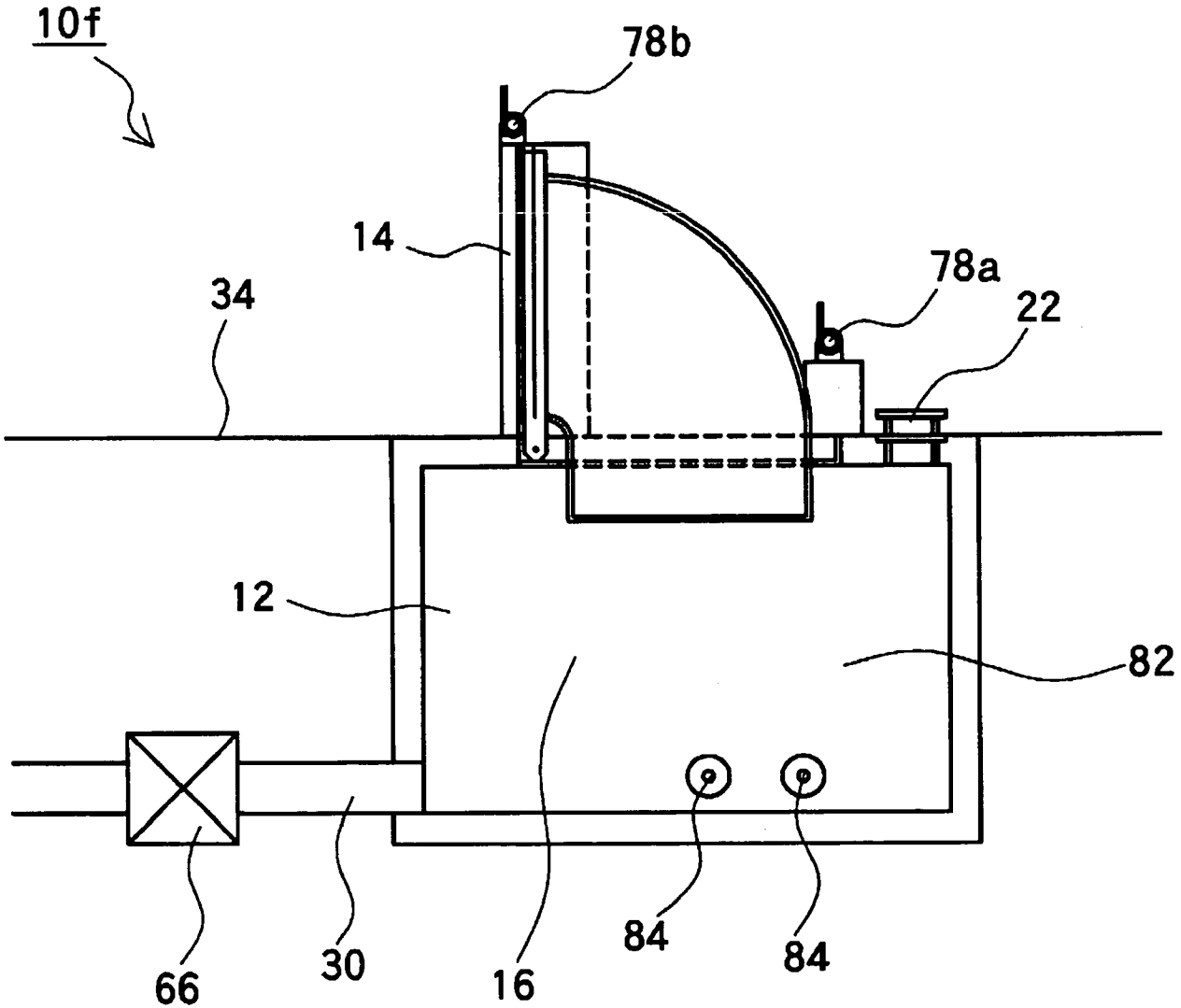
FIG. 23 is a schematic cross-sectional view showing a state in which a winch is operated for the tide apparatus of FIG. 22.

The configuration of a tide apparatus 10*f* shown in FIGS. 22 and 23 is basically equivalent to that of the tide apparatus 10*a* in accordance with the embodiment shown in FIGS. 1 to 3. Consequently, elements equivalent to those illustrated in FIGS. 1 to 3 are numerically numbered similarly and the detailed descriptions of the equivalent elements are omitted.

The tide apparatus 10*f* shown in FIG. 22 is provided with a tide plate 14 of a rotating type and a winch 78 similar to that of the tide apparatus 10*e* shown in FIGS. 18 to 21.

In the case of the tide plate 14 of a rotating type, it is preferable to form a winch 78*a* for pulling down the tide plate 14 in such a manner that the tide plate 14 is prevented from operating in normal rainfall, and a winch 78*b* for forcibly pulling up the tide plate 14 above the soil foundation face in advance for preparing against a tsunami or a flood.

A wire 82 to be used for pulling up the tide plate 14 is preferably housed in a separately formed housing box (not shown) under the normal conditions, and taken out from the box in use.

As described above, even in the case of the tide plate 14 of a rotating type, the tide plate 14 can be prevented from operating in normal rainfall. In addition, even in the case in which the tide plate 14 protrudes upward from the soil foundation face 34, the tide plate 14 can be forcibly pulled below the soil foundation face by the winch 78*a*, thereby preventing the tide plate 14 from obstructing the passage.

Moreover, the tide plate 14 can be made to protrude from the soil foundation face 34 in advance by the winch 78*b* for preparing against a tsunami or a flood.

Figure 24:
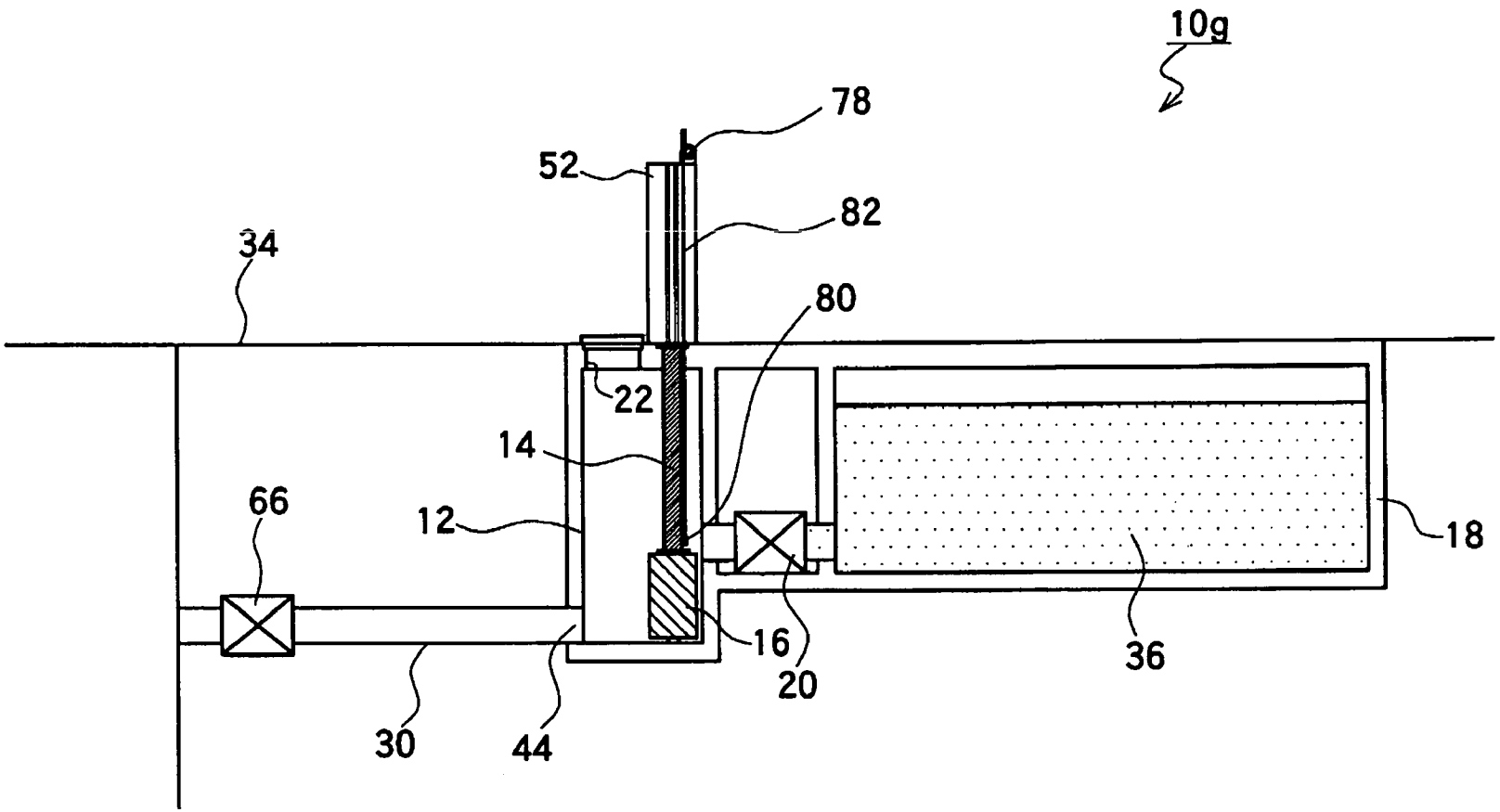
FIG. 24 is a schematic cross-sectional view showing a normal state of an eighth embodiment of a tide apparatus in accordance with the present invention.
Figure 25:
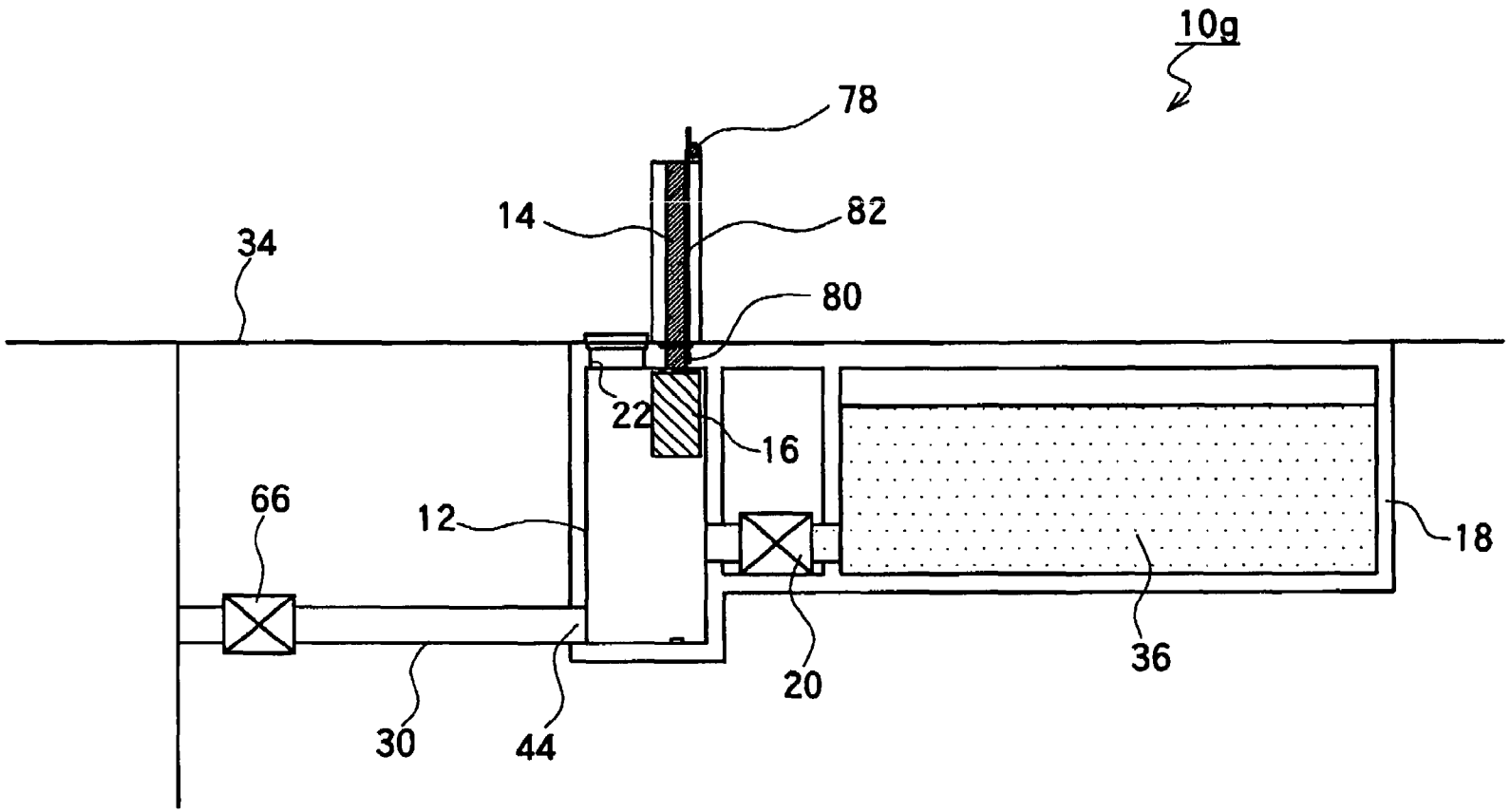
FIG. 25 is a schematic cross-sectional view showing a state in which a winch is operated for the tide apparatus of FIG. 24.

The configuration of a tide apparatus 10*g* shown in FIGS. 24 and 25 is basically equivalent to that of the tide apparatus 10*a* in accordance with the embodiment shown in FIGS. 1 to 3. Consequently, elements equivalent to those illustrated in FIGS. 1 to 3 are numerically numbered similarly and the detailed descriptions of the equivalent elements are omitted.

The tide apparatus 10*g* shown in FIG. 24 is provided with both a seismograph releasing apparatus 20 formed for preparing against an earthquake and a winch 78.

For the tide apparatus 10*g*, the tide plate 14 can be prevented from, protruding from the soil foundation face 34 by water flowing into the underground pit 12 in normal rainfall. In addition, the seismograph releasing apparatus 20 is operated in an emergency such as an earthquake, and the water stored in the storage tank 18 in advance is made to flow into the underground pit 12, thereby enabling the tide plate 14 to protrude from the soil foundation face 34.

The tide plate 14 made to protrude from the soil foundation face 34 can be forcibly housed under the soil foundation face 34 by the winch 78.

The tide apparatus 10*g* is preferably provided with a canceling function of canceling a lock for holding the tide plate 14 under the soil foundation face 34 by the winch 78 in the case in which the seismograph releasing apparatus 20 is operated.

In case the seismograph releasing apparatus 20 is not operated, the tide plate 14 is pulled above the soil foundation face 34 by the winch 78 as shown in FIG. 25, thereby preparing against a tsunami or a flood in advance.

Figure 26:
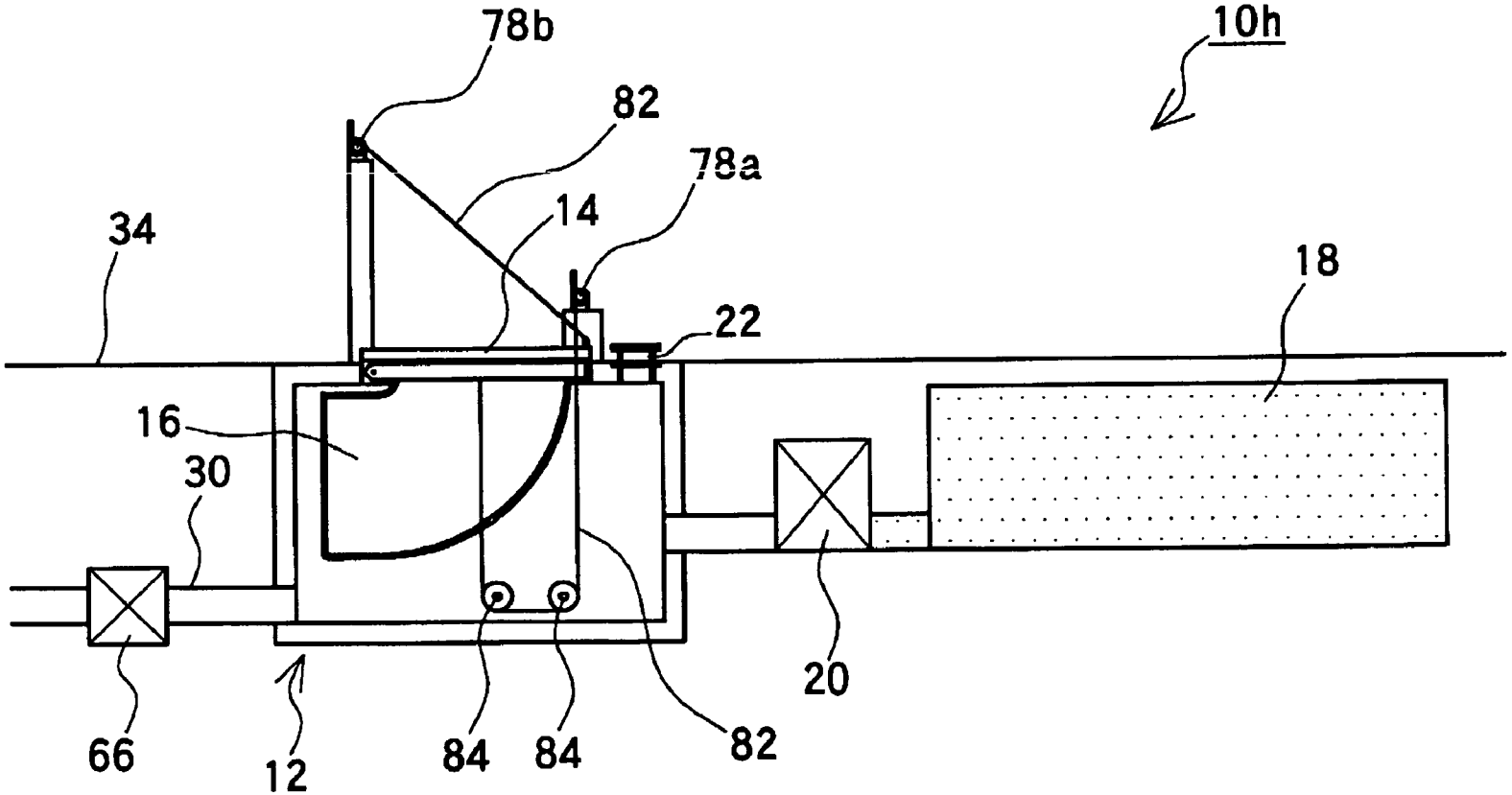
FIG. 26 is a schematic cross-sectional view showing a normal state of a ninth embodiment of a tide apparatus in accordance with the present invention.
Figure 27:
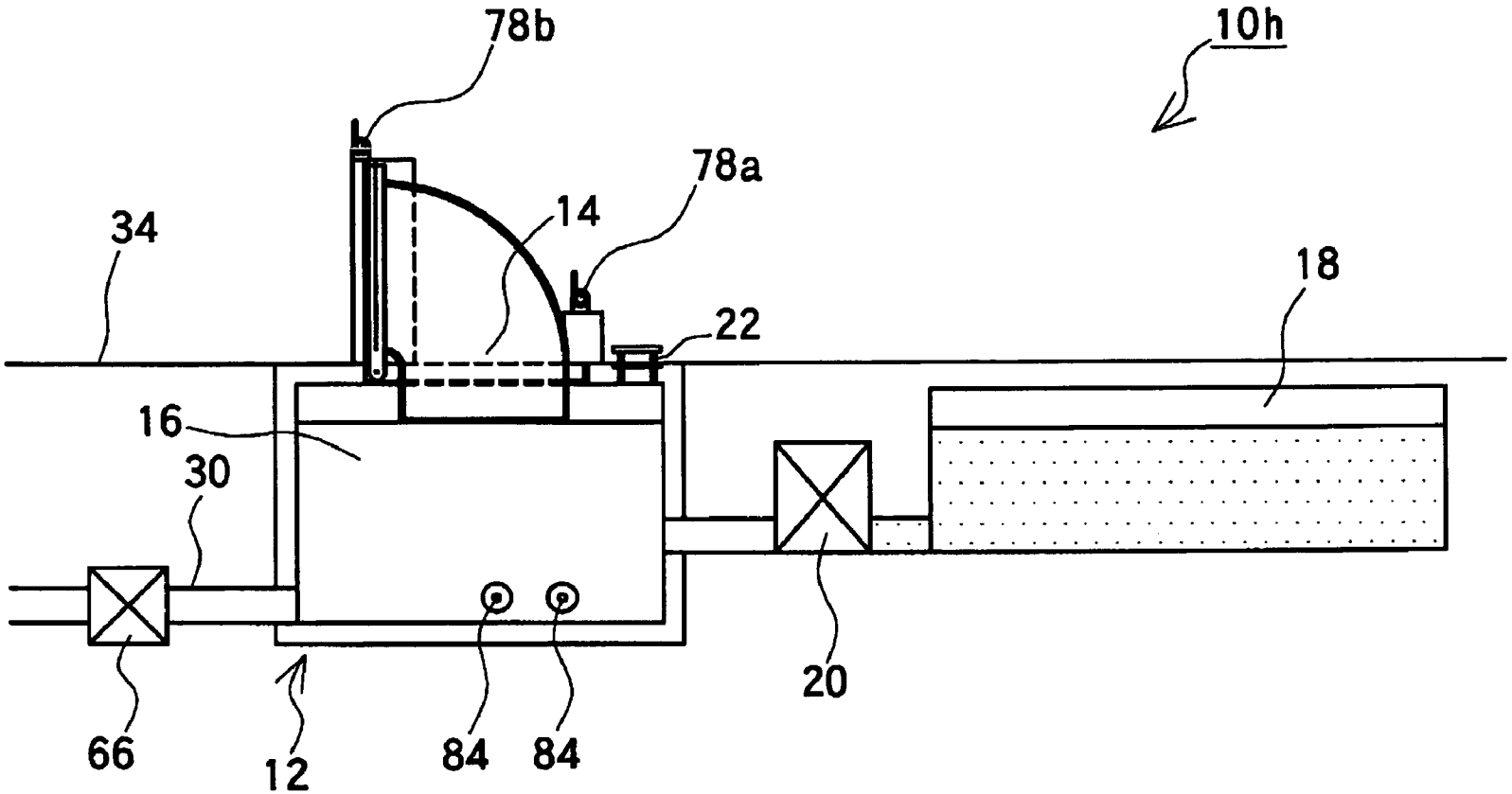
FIG. 27 is a schematic cross-sectional view showing a state in which a winch is operated for the tide apparatus of FIG. 26.
Figure 28:
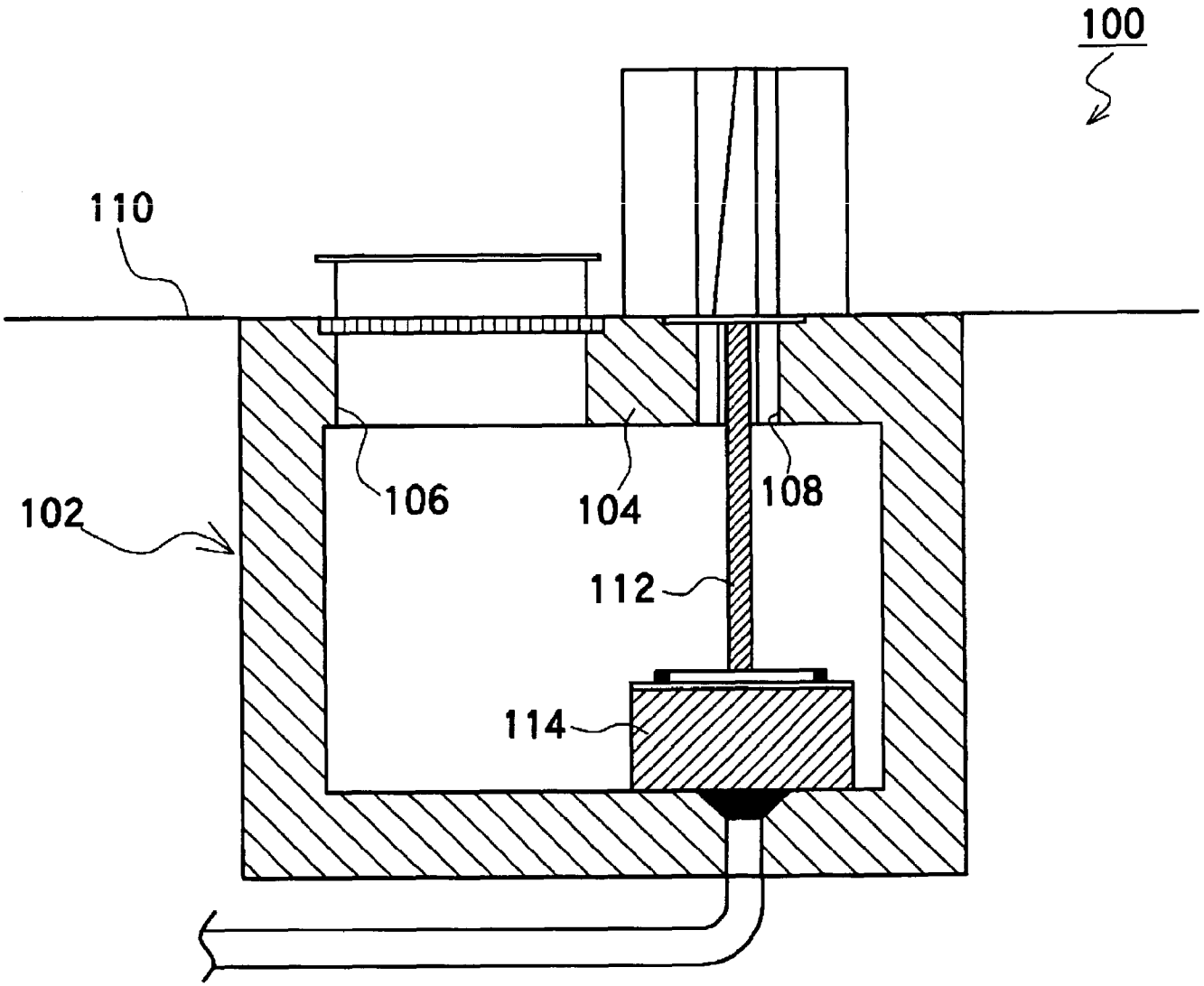
Fig. 28 PRIOR ART
FIG. 28 is a schematic cross-sectional view illustrating a conventional tide apparatus.
Figure 29:
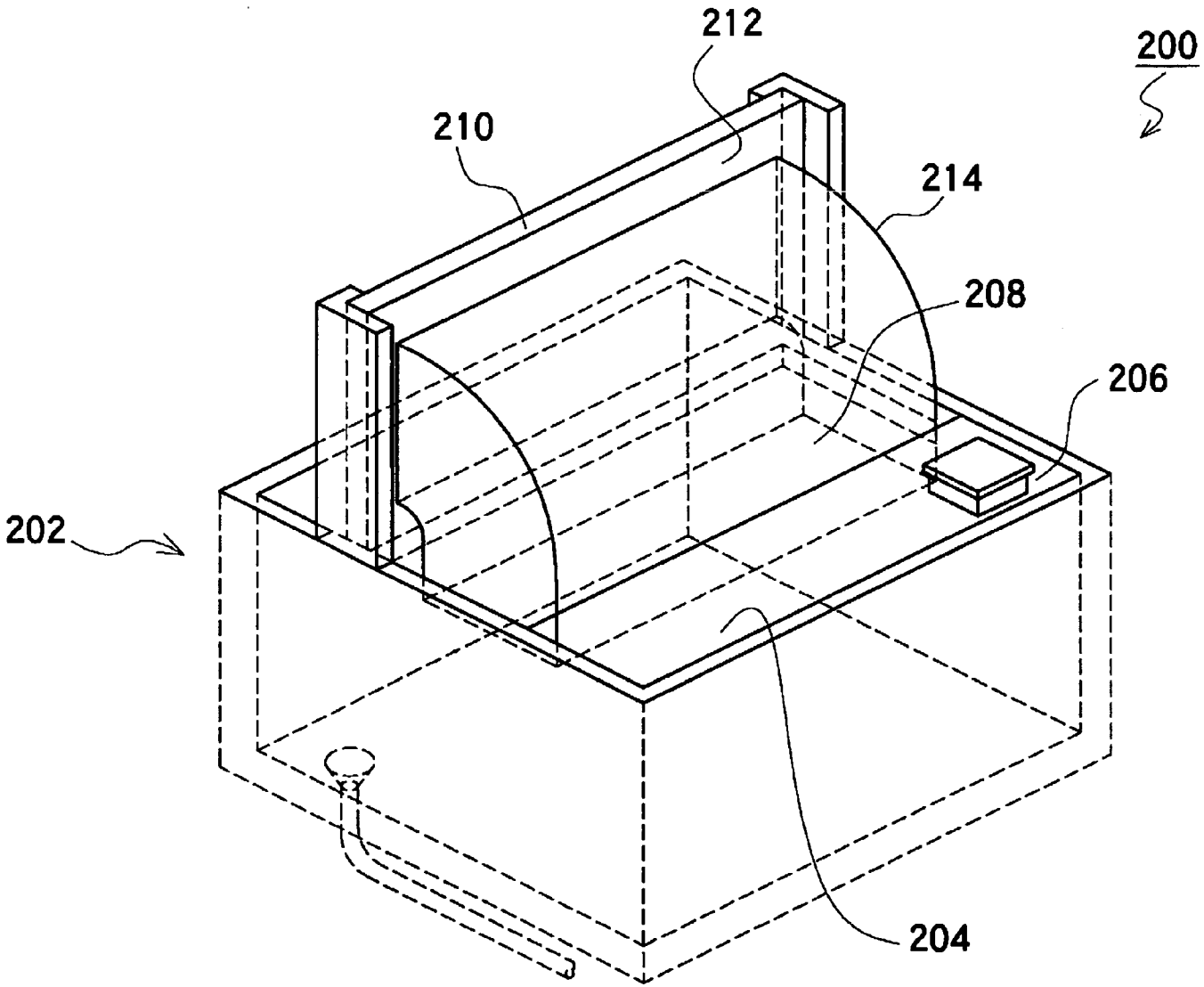
Fig. 29 PRIOR ART
FIG. 29 is a perspective view illustrating a conventional tide apparatus.

The configuration of a tide apparatus 10*h* shown in FIGS. 26 and 27 is basically equivalent to that of the tide apparatus 10*a* in accordance with the embodiment shown in FIGS. 1 to 3. Consequently, elements equivalent to those illustrated in FIGS. 1 to 3 are numerically numbered similarly and the detailed descriptions of the equivalent elements are omitted.

The tide apparatus 10*h* shown in FIG. 26 is provided with a tide plate 14 of a rotating type. Similarly to the tide apparatus 10*g* shown in FIGS. 24 and 25, the tide apparatus 10*h* is also provided with both a seismograph releasing apparatus 20 formed for preparing against an earthquake and a winch 78.

In the case of the tide plate 14 of a rotating type, it is preferable to form a winch 78*a* for pulling down the tide plate 14 in such a manner that the tide plate 14 is prevented from operating in normal rainfall, and a winch 78*b* for forcibly pulling up the tide plate 14 above the soil foundation face in advance for preparing against a tsunami or a flood.

A wire 82 to be used for pulling up the tide plate 14 is preferably housed in a separately formed housing box (not shown) under the normal conditions, and taken out from the box in use.

For the tide apparatus 10*h*, the tide plate 14 can be prevented from protruding from the soil foundation face 34 by water flowing into the underground pit 12 in normal rainfall. In addition, the seismograph releasing apparatus 20 is operated in an emergency such as an earthquake, and the water stored in the storage tank 18 in advance is made to flow into the underground pit 12, thereby enabling the tide plate 14 to protrude from the soil foundation face 34.

The tide plate 14 made to protrude from the soil foundation face 34 can be forcibly housed under the soil foundation face 34 by the winch 78.

The tide apparatus 10*g* is preferably provided with a canceling function of canceling a lock for holding the tide plate 14 under the soil foundation face 34 by the winch 78 in the case in which the seismograph releasing apparatus 20 is operated.

In case the seismograph releasing apparatus 20 is not operated, the tide plate 14 is pulled above the soil foundation face 34 by the winch 78 as shown in FIG. 27, thereby preparing against a tsunami or a flood in advance.

As described above, even in the case of the tide plate 14 of a rotating type, the tide plate 14 can be prevented from operating in normal rainfall. In addition, even in the case in which the tide plate 14 protrudes upward from the soil foundation face 34, the tide plate 14 can be forcibly pulled below the soil foundation face 34 by the winch 78*a*, thereby preventing the tide plate 14 from obstructing the passage.

Moreover, the tide plate 14 can be made to protrude from the soil foundation face 34 in advance by the winch 78*b* for preparing against a tsunami or a flood.

While the preferred embodiments of the present invention have been described above, the present invention is not restricted to the embodiments. While the tide apparatus provided with the tide plate of a rising and setting type and the tide apparatus provided with the tide plate of a 900 pivoting type have been illustrated as examples in the above embodiments, the present invention is not restricted to the embodiments, and various changes and modifications can be thus made without departing from the scope of the present invention.

The invention claimed is:

1. A tide apparatus comprising:

an underground pit formed under a soil foundation face;

a water inflow port and a tide plate operation opening for vertically penetrating into a ceiling wall of the underground pit;

a tide plate linked to a floating member at the bottom end thereof in the underground pit for floating together with the floating member by a buoyancy of water; wherein the tide plate can protrude upward from the soil foundation face through the tide plate operation opening by making water flow into the underground pit via the inflow port of the ceiling wall;

a storage tank connected to the underground pit for normally storing water of a constant amount;

a connecting pipe for connecting between the underground pit and the storage tank; and a seismograph releasing apparatus formed on the connecting pipe for sensing a shake in an earthquake and for releasing the water stored in the storage tank into the underground pit;

wherein the tide plate can protrude upward from the soil foundation face by operating the seismograph releasing apparatus in an earthquake to make the water stored in the storage tank flow into the underground pit via the connecting pipe.

2. The tide apparatus as defined in claim 1, wherein the storage tank is formed under the soil foundation face.

3. The tide apparatus as defined in claim 1, wherein the storage tank is formed over the soil foundation face.

4. A tide structure wherein a plurality of the tide apparatuses as defined in claim 1 is disposed in parallel.

5. A tide apparatus comprising:

an underground pit formed under a soil foundation face;

a water inflow port and a tide plate operation opening for vertically penetrating into a ceiling wall of the underground pit;

a tide plate rotatably mounted in a pivoting manner to one end of the tide plate operation opening;

a floating member located in the underground pit and linked to a surface on the underground pit side of the tide plate via the operation opening; wherein the floating member rises via the tide plate operation opening and rotates the tide plate by making water flow into the underground pit via the inflow port of the ceiling wall, thereby installing the tide plate in a standing manner above the soil foundation face;

a storage tank connected to the underground pit for normally storing water of a constant amount;

a connecting pipe for connecting between the underground pit and the storage tank; and a seismograph releasing apparatus formed on the connecting pipe for sensing a shake in an earthquake and for releasing the water stored in the storage tank into the underground pit;

wherein the tide plate can protrude upward from the soil foundation face by operating the seismograph releasing apparatus in an earthquake to make the water stored in the storage tank flow into the underground pit via the connecting pipe.

6. The tide apparatus as defined in claim 5, wherein the storage tank is formed under the soil foundation face.

7. The tide apparatus as defined in claim 5, wherein the storage tank is formed over the soil foundation face.

8. A tide structure wherein a plurality of the tide apparatuses as defined in claim 5 is disposed in parallel.

9. A tide apparatus comprising:

an underground pit formed under a soil foundation face;

a water inflow port and a tide plate operation opening for vertically penetrating into a ceiling wall of the underground pit;

a tide plate linked to a floating member at the bottom end thereof in the underground pit for floating together with the floating member by a buoyancy of water; wherein the tide plate can protrude upward from the soil foundation face through the tide plate operation opening by making water flow into the underground pit via the inflow port of the ceiling wall;

a storage tank connected to the underground pit for normally storing water of a constant amount;

a connecting pipe for connecting between the underground pit and the storage tank;

a seismograph releasing apparatus formed on the connecting pipe for sensing a shake in an earthquake and for releasing the water stored in the storage tank into the underground pit; and a winch for forcibly moving the tide plate up and down;

wherein the tide plate can protrude upward from the soil foundation face by canceling a lock of the winch and operating the seismograph releasing apparatus in an earthquake to make the water stored in the storage tank flow into the underground pit via the connecting pipe, and the tide plate can be forcibly pulled down by the winch in the state in which the water is made to flow into the underground pit.

10. The tide apparatus as defined in claim 9, wherein the storage tank is formed under the soil foundation face.

11. The tide apparatus as defined in claim 9, wherein the storage tank is formed over the soil foundation face.

12. A tide structure wherein a plurality of the tide apparatuses as defined in claim 9 is disposed in parallel.

13. A tide apparatus comprising:

an underground pit formed under a soil foundation face;

a water inflow port and a tide plate operation opening for vertically penetrating into a ceiling wall of the underground pit;

a tide plate rotatably mounted in a pivoting manner to one end of the tide plate operation opening;

a floating member located in the underground pit and linked to a surface on the underground pit side of the tide plate via the operation opening; wherein the floating member rises via the tide plate operation opening and rotates the tide plate by making water flow into the underground pit via the inflow port of the ceiling wall, thereby installing the tide plate in a standing manner above the soil foundation face;

a storage tank connected to the underground pit for normally storing water of a constant amount;

a connecting pipe for connecting between the underground pit and the storage tank;

a seismograph releasing apparatus formed on the connecting pipe for sensing a shake in an earthquake and for releasing the water stored in the storage tank into the underground pit; and a winch for forcibly moving the tide plate up and down;

wherein the tide plate can protrude upward from the soil foundation face by canceling a lock of the winch and operating the seismograph releasing apparatus in an earthquake to make the water stored in the storage tank flow into the underground pit via the connecting pipe, and the tide plate can be forcibly pulled down by the winch in the state in which the water is made to flow into the underground pit.

14. The tide apparatus as defined in claim 13, wherein the storage tank is formed under the soil foundation face.

15. The tide apparatus as defined in claim 13, wherein the storage tank is formed over the soil foundation face.

16. A tide structure wherein a plurality of the tide apparatuses as defined in claim 13 is disposed in parallel.

* * * * *

UNITED STATES PATENT AND TRADEMARK OFFICE

CERTIFICATE OF CORRECTION

PATENT NO. : 7,658,572 B2
APPLICATION NO. : 11/663245
DATED : February 9, 2010
INVENTOR(S) : Miyao et al.

It is certified that error appears in the above-identified patent and that said Letters Patent is hereby corrected as shown below:

Title Page
Face of the Patent, Item (73) Assignee: "Spacetech, Co., Ltd." should read
-- Spacetech. Co., Ltd. --

Signed and Sealed this

Twenty-fifth Day of May, 2010

David J. Kappos

David J. Kappos
*Director of the United States Patent and Trademark Office*